US011538396B2

(12) United States Patent
Lee

(10) Patent No.: US 11,538,396 B2
(45) Date of Patent: Dec. 27, 2022

(54) DISPLAY DEVICE, DRIVE CIRCUIT, AND DRIVING METHOD

(71) Applicant: LG DISPLAY CO., LTD., Seoul (KR)

(72) Inventor: Jaehyuk Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/467,947

(22) Filed: Sep. 7, 2021

(65) Prior Publication Data

US 2022/0122512 A1 Apr. 21, 2022

(30) Foreign Application Priority Data

Oct. 16, 2020 (KR) ..... 10-2020-0134438

(51) Int. Cl.
*G09G 3/3258* (2016.01)
*G09G 3/20* (2006.01)

(52) U.S. Cl.
CPC ... *G09G 3/2092* (2013.01); *G09G 2300/0842* (2013.01); *G09G 2310/0267* (2013.01); *G09G 2310/0275* (2013.01); *G09G 2310/061* (2013.01)

(58) Field of Classification Search
CPC ..... G09G 3/2092; G09G 2300/0842; G09G 2310/0267; G09G 2310/0275; G09G 2310/061; G09G 2320/0295; G09G 2320/045; G09G 3/3291; G09G 3/3233; G09G 3/3266; G09G 2320/0233
See application file for complete search history.

(56) References Cited

U.S. PATENT DOCUMENTS

2009/0213046 A1* 8/2009 Nam ..... G09G 3/3233 345/76
2014/0361960 A1* 12/2014 Yamauchi ..... G09G 3/3233 345/76
2015/0049075 A1* 2/2015 Lim ..... G09G 5/397 345/212
2015/0062192 A1* 3/2015 Kim ..... G09G 3/3233 345/690
2015/0187268 A1* 7/2015 Tani ..... G09G 3/3233 345/77
2016/0125796 A1* 5/2016 Ohara ..... G09G 3/3291 345/77
2016/0148578 A1* 5/2016 Kishi ..... G09G 3/3291 345/212
2016/0189627 A1* 6/2016 Park ..... G09G 3/3233 345/78
2017/0092197 A1* 3/2017 Fujimura ..... G09G 3/3266
2018/0151112 A1* 5/2018 Song ..... G09G 3/3291
2018/0190198 A1* 7/2018 Kim ..... G09G 3/3233
2019/0066590 A1* 2/2019 Li ..... G09G 3/3258
2019/0197959 A1* 6/2019 Noh ..... G09G 3/3266
2020/0020278 A1* 1/2020 Lee ..... G09G 3/3275
2020/0388220 A1* 12/2020 Xu ..... G09G 3/3291
2021/0065629 A1* 3/2021 Yang ..... G09G 3/3275
2021/0150971 A1* 5/2021 Pyun ..... G09G 3/3233
(Continued)

*Primary Examiner* — Jose R Soto Lopez
(74) *Attorney, Agent, or Firm* — Fenwick & West LLP

(57) ABSTRACT

Provided are a display device, a drive circuit, and a driving method. An accurate threshold voltage compensation value is calculated by finely and incrementally correcting the threshold voltage compensation value in real time during display driving. Consequently, a threshold voltage is accurately and rapidly compensated for.

13 Claims, 15 Drawing Sheets

(56) References Cited

U.S. PATENT DOCUMENTS

| | | | | |
|---|---|---|---|---|
| 2021/0174737 | A1* | 6/2021 | Park | G09G 3/20 |
| 2021/0201776 | A1* | 7/2021 | Yuan | G09G 3/3233 |
| 2021/0225287 | A1* | 7/2021 | Meng | G09G 3/3291 |
| 2021/0248958 | A1* | 8/2021 | Park | G09G 3/2007 |
| 2021/0327367 | A1* | 10/2021 | An | G09G 3/3685 |
| 2021/0407403 | A1* | 12/2021 | Yin | G09G 3/3618 |
| 2022/0013072 | A1* | 1/2022 | Kim | G09G 3/3266 |
| 2022/0036818 | A1* | 2/2022 | Yin | G09G 3/3233 |
| 2022/0068203 | A1* | 3/2022 | Lee | G09G 3/2092 |

* cited by examiner

DISPLAY DEVICE, DRIVE CIRCUIT, AND DRIVING METHOD

CROSS REFERENCE TO RELATED APPLICATION

This application claims priority from Republic of Korea Patent Application No. 10-2020-0134438, filed on Oct. 16, 2020, which is hereby incorporated by reference in its entirety.

BACKGROUND

Field

Embodiments of the present disclosure relate to a display device, a drive circuit, and a driving method.

Description of Related Art

Among display devices currently in development, there are self-luminous display devices, in each of which subpixels disposed in a display panel respectively include an emitting diode (ED). Each of subpixels disposed in the display panel of the self-luminous display device may include the emitting diode capable of emitting light by itself and a driver transistor driving the emitting diode.

Each of the driver transistors disposed in the display panel of the self-luminous display device may have a threshold voltage as a unique characteristic thereof.

As the driver transistor in each of the subpixels is subjected to degradation over driving time, the threshold voltage thereof may change. Since the subpixels may have different driving times, the driver transistors may have different threshold voltages, thereby causing the subpixels to have different luminous intensities. The different luminous intensities of the subpixels may be a major factor that reduces the luminous uniformity of the display panel, thereby causing deterioration in image quality. Accordingly, a variety of compensation technologies for compensating for different threshold voltages by sensing the threshold voltages of the driver transistors have been developed.

However, current threshold voltage compensation technologies require a significant amount of time to sense the threshold voltage of a single driver transistor. Thus, a very long time must be taken to sense the threshold voltages of all of the driver transistors provided in the display panel. Thus, there is a problem in that threshold voltage compensation technologies of the related art fail to sense and compensate for the threshold voltages of the driver transistors in real time during display driving.

SUMMARY

The present disclosure may provide a display device, a drive circuit, and a driving method able to compensate for a change in the threshold voltage of each of driver transistors in real time during display driving.

The present disclosure may provide a display device, a drive circuit, and a driving method able to rapidly sense and compensate for a change in the threshold voltage of each of driver transistors in real time even in the case that the threshold voltage of the driver transistor has deteriorated during display driving.

The present disclosure may provide a display device, a drive circuit, and a driving method able to rapidly sense and compensate for a change in a threshold voltage caused by a change in the surrounding environment, such as temperature or moisture.

Embodiments of the present disclosure may provide a display device including: a display panel including a plurality of data lines, a plurality of scan signal lines, a plurality of sense signal lines, a plurality of reference voltage lines, and a plurality of subpixels, each of the plurality of subpixels including an emitting diode, a driver transistor, and a storage capacitor; a data driver circuit outputting data voltages to the plurality of data lines; and a gate driver circuit outputting scan signals to the plurality of scan signal lines and outputting sense signals to the plurality of sense signal lines. The plurality of subpixels may include a first subpixel connected to a first data line from among the plurality of data lines and a first reference voltage line from among the plurality of reference voltage lines.

The data driver circuit may output a first data voltage to the first data line during a first blank period and outputs a second data voltage different from the first data voltage to the first data line during a second blank period after the first blank period.

The second data voltage supplied to the first data line during the second blank period may be set different from the first data voltage depending on whether or not a current flows through the driver transistor in the first subpixel during the first blank period.

When the current flows through the driver transistor in the first subpixel during the first blank period, the second data voltage supplied to the first data line during the second blank period may be set lower than the first data voltage. When the current does not flow through the driver transistor in the first subpixel during the first blank period, the second data voltage supplied to the first data line during the second blank period may be set higher than the first data voltage.

When the current flows through the driver transistor in the first subpixel during the first blank period, the second data voltage may be a voltage obtained by subtracting a preset fine correction value from the first data voltage. When the current does not flow through the driver transistor in the first subpixel during the first blank period, the second data voltage may be a voltage obtained by adding the preset fine correction value to the first data voltage.

The display device according to embodiments of the present disclosure may further include: a memory storing a threshold voltage compensation value regarding the driver transistor in the first subpixel; and a compensation controller updating the threshold voltage compensation value stored in the memory.

When the current flows through the driver transistor in the first subpixel during the first blank period, the compensation controller may update the threshold voltage compensation value stored in the memory to be reduced by a preset fine correction value. When the current does not flow through the driver transistor in the first subpixel during the first blank period, the compensation controller may update the threshold voltage compensation value stored in the memory to be increased by the preset fine correction value.

Embodiments of the present disclosure may provide a method of driving a display device, the method including: a first sensing operation of outputting a first data voltage to a first data line, from among plurality of data lines, connected to a first subpixel, from among a plurality of subpixels, during a first blank period; and a second sensing operation of outputting a second data voltage different from the first data voltage to the first data line connected to the first subpixel during a second blank period after the first blank period.

The second data voltage supplied to the first data line during the second blank period may be set different from the first data voltage depending on whether or not a current flows through the driver transistor in the first subpixel during the first blank period.

Embodiments of the present disclosure may provide a drive circuit including a data voltage output circuit outputting data voltages to the plurality of data lines; and a power switch controlling connection between a reference voltage supply node to which a reference voltage is applied and a corresponding reference voltage line from among the plurality of reference voltage lines.

The data voltage output circuit may output a first data voltage to the first data line during a first blank period and outputs a second data voltage different from the first data voltage to the first data line during a second blank period after the first blank period. The second data voltage supplied to the first data line during the second blank period may be set different from the first data voltage depending on whether or not a current flows through the driver transistor in the first subpixel.

According to embodiments, the display device, the drive circuit, and the driving method may compensate for a change in the threshold voltage of each of driver transistors in real time during display driving.

According to embodiments, the display device, the drive circuit, and the driving method may rapidly sense and compensate for a change in the threshold voltage of each of driver transistors in real time even in the case that the threshold voltage of the driver transistor has deteriorated during display driving.

According to embodiments, the display device, the drive circuit, and the driving method may rapidly sense and compensate for a change in a threshold voltage caused by a change in the surrounding environment, such as temperature or moisture.

BRIEF DESCRIPTION OF THE DRAWINGS

The above and other objectives, features, and advantages of the present disclosure will be more clearly understood from the following detailed description, taken in conjunction with the accompanying drawings, in which.

DETAILED DESCRIPTION

Figure 1:
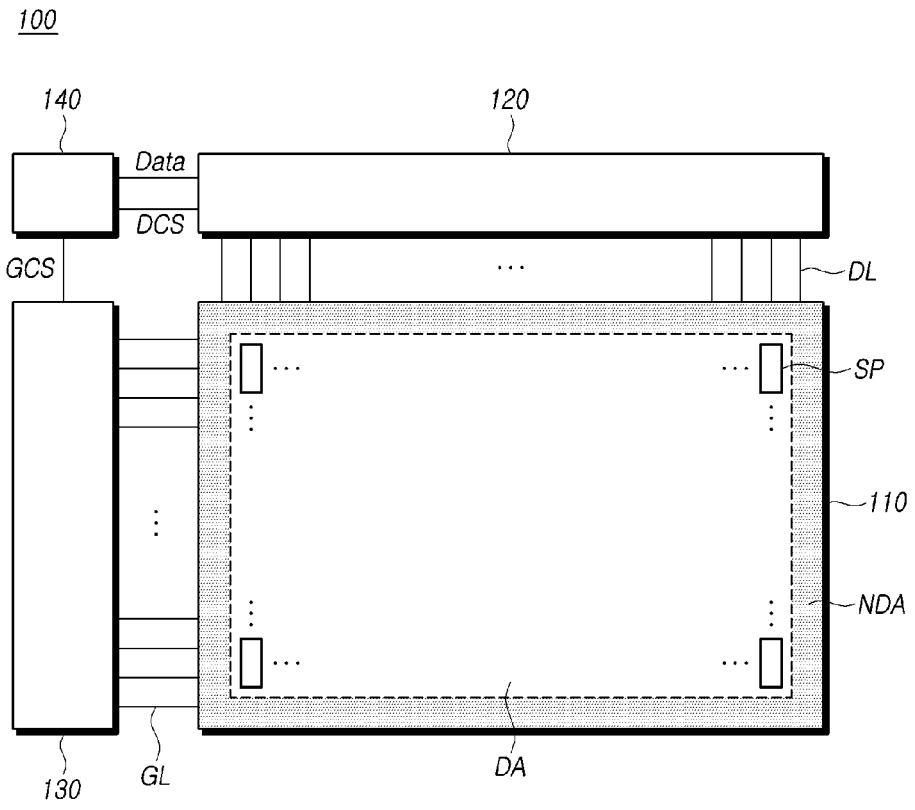
FIG. 1 is a system diagram illustrating a display device according to embodiments of the present disclosure.

In the following description of examples or embodiments of the present invention, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present invention, detailed descriptions of well-known functions and components incorporated herein will be omitted when it is determined that the description may make the subject matter in some embodiments of the present invention rather unclear. The terms such as "including", "having", "containing", "constituting", "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the present invention. Each of these terms is not used to define essence, order, sequence, or plurality of elements etc., but is used merely to distinguish the corresponding element from other elements.

When it is mentioned that a first element "is connected or coupled to", "contacts or overlaps", etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element may be included in at least one of two or more elements that "are connected or coupled to", "contact or overlap", etc. each other.

When time relative terms, such as "after", "subsequent to", "next", "before", and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can".

FIG. 1 is a system diagram illustrating a display device 100 according to embodiments of the present disclosure.

Referring to FIG. 1, the display device 100 according to embodiments of the present disclosure may include a display panel 110 and a drive circuit for driving the display panel 110.

The display panel 110 may include signal lines, such as a plurality of data lines DL and a plurality of gate lines GL, and a plurality of subpixels SP. The display panel 110 may include a display area (or an active area) DA on which images are displayed and a non-display area (or a non-active area) NDA on which images are not displayed. In the display panel 110, the plurality of subpixels SP for displaying an image may be disposed in the display area DA, and pads may be disposed in the non-display area NDA. Driver circuits 120, 130, and 140 may be mounted on or electrically connected to the pads, and integrated circuits (ICs), printed circuits, and the like may be connected to the pads.

The driver circuits may include a data driver circuit 120, a gate driver circuit 130, and the like, and may further include a controller 140 controlling the data driver circuit 120 and the gate driver circuit 130.

The data driver circuit 120 is a circuit for driving the plurality of data lines DL, and is configured to supply data signals to the plurality of data lines DL. The gate driver circuit 130 is a circuit for driving the plurality of gate lines GL, and is configured to supply gate signals to the plurality of gate lines GL.

The gate driver circuit 130 may output a gate signal having a turn-on-level voltage or a gate signal having a turn-off-level voltage under the control of the controller 140. The gate driver circuit 130 may sequentially drive the plurality of gate lines GL by sequentially supplying the gate signal having the turn-on-level voltage to the plurality of gate lines GL.

The controller 140 may supply a data control signal DCS to the data driver circuit 120 in order to control the operation timing of the data driver circuit 120. The controller 140 may supply a gate control signal GCS to the gate driver circuit 130 in order to control the operation timing of the gate driver circuit 130.

The controller 140 may start scanning at points in time set in respective frames, convert image data input from an external source into a data signal format used by the data driver circuit 120, supply the converted image data to the data driver circuit 120, and control data driving at appropriate points in time in response to the scanning.

The controller 140 receives timing signals, such as a vertical synchronization signal Vsync, a horizontal synchronization signal Hsync, an input data enable signal DE, and a clock signal CLK, generates a variety of control signals DCS and GCS, and outputs the control signals DCS and GCS to the data driver circuit 120 and the gate driver circuit 130 in order to control the data driver circuit 120 and the gate driver circuit 130.

The controller 140 may be implemented as a component separate from the data driver circuit 120 or may be combined with the data driver circuit 120 to form an integrated circuit (IC).

The data driver circuit 120 drives the plurality of data lines DL by receiving image data Data from the controller 140 and supplying a data voltage to the plurality of data lines DL. Here, the data driver circuit 120 is also referred to as a source driver circuit. The data driver circuit 120 may include one or more source driver ICs (SDICs). Each of the source driver ICs may include a shift register, a latch circuit, a digital-to-analog converter (DAC), an output buffer, and the like. In some cases, each of the source driver ICs may further include an analog-to-digital converter (ADC).

For example, each of the source driver ICs may be connected to the display panel 110 by a tape-automated bonding (TAB) method, may be connected to a bonding pad of the display panel 110 by a chip-on-glass (COG) method or a chip-on-panel (COP) method, or may be implemented as a chip-on-film (COF) circuit connected to the display panel 110.

The gate driver circuit 130 may be connected to the display panel 110 by a tape-automated bonding (TAB) method, may be connected to a bonding pad of the display panel 110 by a chip-on-glass (COG) method or a chip-on-panel (COP) method, or may be connected to the display panel 110 by a chip-on-film (COF) method. Alternatively, the gate driver circuit 130 may be implemented as a gate-in-panel (GIP) circuit provided in the non-display area NDA of the display panel 110.

When a specific gate line GL is opened by the gate driver circuit 130, the data driver circuit 120 may convert the image data Data, received from the controller 140, into an analog data voltage and supply the data voltage to the plurality of data lines DL.

The data driver circuit 120 may be connected to one side (e.g., the upper side or the lower side) of the display panel 110. The data driver circuit 120 may be connected to both sides (e.g., both the upper side and the lower side) of the display panel 110 or to two or more side surfaces from among four side surfaces of the display panel 110 depending on the driving system, the design of the display panel, or the like.

The gate driver circuit 130 may be connected to one side (e.g., the left side or the right side) of the display panel 110. The gate driver circuit 130 may be connected to both sides (e.g., both the left side and the right side) of the display panel 110 or to two or more side surfaces from among four side surfaces of the display panel 110 depending on the driving system, the design of the display panel, or the like.

The controller 140 may be a timing controller used in typical display technology, may be a control device including a timing controller and performing other control functions, may be a controller different from the timing controller, or may be a circuit inside the control device. The controller 140 may be implemented as a variety of circuits or electronic components, such as an integrated circuit (IC), a field programmable gate array (FPGA), an application specific integrated circuit (ASIC), or a processor The controller 140 may be mounted on a printed circuit board (PCB), a flexible printed circuit (FPC), or the like, and may be electrically connected to the data driver circuit 120 and the gate driver circuit 130 through the PCB, the FPC, or the like. The controller 140 may transmit signals to and receive signals from the data driver circuit 120 through at least one predetermined interface. Examples of the interface may include a low voltage D differential signaling (LVDS) interface, an embedded panel interface (EPI), a serial peripheral interface (SPI), and the like. The controller 140 may include a storage location, such as one or more registers.

The display device 100 according to embodiments may be a self-luminous display, such as an organic light-emitting diode (OLED) display, a quantum dot display, a micro light-emitting diode (LED) display, or the like.

Figure 2:
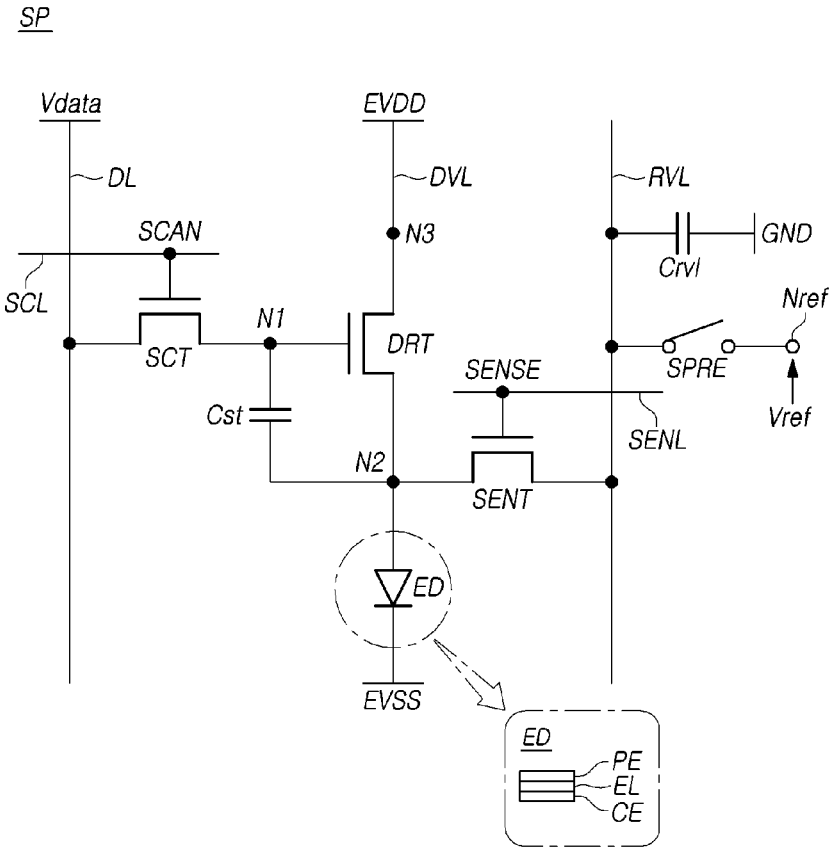
FIG. 2 is a diagram illustrating an equivalent circuit of each of the subpixels of the display device according to embodiments of the present disclosure.

FIG. 2 is a diagram illustrating an equivalent circuit of each of the plurality of subpixels SP of the display device 100 according to embodiments of the present disclosure.

Referring to FIG. 2, the subpixel SP provided in the display panel 110 of the display device 100 according to embodiments of the present disclosure may include an emitting diode ED, a driver transistor DRT, a scan transistor SCT, a sensing transistor SENT, a storage capacitor Cst, and the like. When the subpixel SP includes three transistors DRT, SCT, and SENT and a single capacitor Cst in this manner, the subpixel SP is referred to as having a 3T1C (three transistors and one capacitor) structure.

The emitting diode (ED) may include a pixel electrode PE, a common electrode CE, and an emissive layer EL located between the pixel electrode PE and the common electrode CE. Here, the pixel electrode PE may be disposed in the subpixel SP, and the common electrode CE may be commonly disposed in the subpixel SP. In an example, the pixel electrode PE may be an anode, whereas the common electrode CE may be a cathode. In another example, the pixel electrode PE may be a cathode, whereas the common electrode CE may be an anode. For example, the emitting diode ED may be an organic light-emitting diode (OLED), a micro light-emitting diode (LED), a quantum dot light-emitting diode (QD-LED), or the like.

The driver transistor DRT is a transistor for driving the emitting diode ED, and may include a first node N1, a second node N2, a third node N3, and the like.

The first node N1 of the driver transistor DRT may be a gate node of the driver transistor DRT, and may be electrically connected to a source node or a drain node of the scan transistor SCT. The second node N2 of the driver transistor DRT may be a source node or a drain node of the driver transistor DRT, may be electrically connected to a source node or a drain node of the sensing transistor SENT, and may be electrically connected to the pixel electrode PE of the emitting diode ED. The third node N3 of the driver transistor DRT may be electrically connected to a drive voltage line DVL through which a driving voltage EVDD is supplied.

The scan transistor SCT is controlled by a scan signal SCAN, and may be connected to the first node N1 of the transistor DRT and to a data line DL. The scan transistor SCT may be turned on or off by the scan signal SCAN supplied through a scan signal line SCL, i.e., a type of gate line GL, to control the connection between the data line DL and the first node N1 of the driver transistor DRT.

The scan transistor SCT may be turned on by the scan signal SCAN having a turn-on-level voltage to transfer a data voltage Vdata, supplied through the data line DL, to the first node N1 of the driver transistor DRT.

The turn-on-level voltage of the scan signal SCAN capable of turning the scan transistor SCT on may be a high-level voltage or a low-level voltage. The turn-off-level voltage of the scan signal SCAN capable of turning the scan transistor SCT off may be a low-level voltage or a high-level voltage. In an example, when the scan transistor SCT is an n-type transistor, the turn-on-level voltage may be a high-level voltage and the turn-off-level voltage may be a low-level voltage. In another example, when the scan transistor SCT is a p-type transistor, the turn-on-level voltage may be a low-level voltage and the turn-off-level voltage may be a high-level voltage.

The sensing transistor SENT may be controlled by a sense signal SENSE, and may be connected to the second node N2 of the driver transistor DRT and to a reference voltage line RVL. The sensing transistor SENT may be turned on or off by the sense signal SENSE, supplied through a sense signal line SENL (i.e., another type of gate line GL) to control the connection between the reference voltage line RVL and the second node N2 of the driver transistor DRT.

The sensing transistor SENT may be turned on by the sense signal SENSE having a turn-on-level voltage to transfer a reference voltage Vref, supplied through the reference voltage line RVL, to the second node N2 of the driver transistor DRT.

The turn-on-level voltage of the sense signal SENSE capable of turning the sensing transistor SENT on may be a high-level voltage or a low-level voltage that is less than the high-level voltage. The off-level voltage of the sense signal SENSE capable of turning the sensing transistor SENT off may be a low-level voltage or a high-level voltage that is greater than the low-level voltage. In an example, when the sensing transistor SENT is an n-type transistor, the turn-on-level voltage may be a high-level voltage and the turn-off-level voltage may be a low-level voltage. In another example, when the sensing transistor SENT is a p-type transistor, the turn-on-level voltage may be a low-level voltage and the turn-off-level voltage may be a high-level voltage.

In addition, the display device 100 may further include a line capacitor Crvl provided between the reference voltage line RVL and a ground GND and a power switch SPRE for controlling the connection between the reference voltage line RVL and a reference voltage supply node Nref. The reference voltage Vref output by a power supply may be supplied to the reference voltage supply node Nref to be applied to the reference voltage line RVL through the power switch SPRE.

In addition, the sensing transistor SENT may be turned on by the sense signal SENSE having a turn-on-level voltage to transfer a voltage from the second node N2 of the driver transistor DRT to the reference voltage line RVL. Consequently, the line capacitor Crvl provided between the reference voltage line RVL and the ground GND may be charged.

The function of the sensing transistor SENT of transferring a voltage from the second node N2 of the driver transistor DRT to the reference voltage line RVL may be used in driving for sensing characteristics of the subpixel SP. In this case, the voltage transferred to the reference voltage line RVL may be a voltage for calculating the characteristics of the subpixel SP or a voltage on which the characteristics of the subpixel SP are reflected.

In the present disclosure, the characteristics of the subpixel SP may be characteristics of the driver transistor DRT or the emitting diode ED. The characteristics of the driver transistor DRT may include the threshold voltage, mobility, etc. of the driver transistor DRT. The characteristics of the of the emitting diode ED may include the threshold voltage of the emitting diode ED.

Each of the driver transistor DRT, the scan transistor SCT, and the sensing transistor SENT may be an n-type transistor or a p-type transistor. In the present disclosure, for the sake of explanation, each of the driver transistor DRT, the scan transistor SCT, and the sensing transistor SENT may be illustrated as being an n-type transistor.

The storage capacitor Cst may be connected to the first node N1 of the driver transistor DRT and to the second node N2. The storage capacitor Cst is charged with an amount of electric charge corresponding to the difference in the voltage between both ends, and serves to maintain the difference in the voltage between both ends during a predetermined frame time. Consequently, the subpixel SP may emit light during the predetermined frame time.

The storage capacitor Cst may be an external capacitor intentionally designed to be provided externally of the driver transistor DRT, rather than a parasitic capacitor (e.g., gate-source parasitic capacitance Cgs or gate-drain parasitic capacitance Cgd) which is an internal capacitor present between the gate node and the source node (or the drain node) of the driver transistor DRT.

The scan signal line SCL and the sense signal line SENL may be different gate lines GL. In this case, the scan signal SCAN and the sense signal SENSE may be different gate signals, and the on-off timing of the scan transistor SCT and the on-off timing of the sensing transistor SENT in a single subpixel SP may be independent of each other. That is, the on-off timing of the scan transistor SCT and the on-off timing of the sensing transistor SENT in a single subpixel SP may be the same or different from each other.

Alternatively, the scan signal line SCL and the sense signal line SENL may be the same gate line GL. That is, the gate node of the scan transistor SCT and the gate node of the sensing transistor SENT in a single subpixel SP may be connected to a single gate line GL. In this case, the scan signal SCAN and the sense signal SENSE may be the same gate signal, and the on-off timing of the scan transistor SCT and the on-off timing of the sensing transistor SENT in a single subpixel SP may be the same.

In addition, the reference voltage line RVL may be disposed for every subpixel column. Alternatively, the reference voltage line RVL may be disposed for every two or more subpixel columns. When the reference voltage line RVL is disposed for every two or more subpixel columns, two or more subpixels SP may be supplied with the reference voltage Vref through a single reference voltage line RVL.

In addition, the driver transistor DRT included in the subpixel SP provided in the display panel 110 of the display device 100 according to embodiments of the present disclosure may have unique characteristics. For example, the unique characteristics of the driver transistor DRT may include a threshold voltage, mobility, etc.

The characteristics of the driver transistor DRT included in the subpixel SP may change over the drive time. All of the plurality of subpixels SP do not have the same drive time. That is, the drive time of some subpixels SP from among the plurality of subpixels SP may be different from the drive time of the remaining subpixels SP from among the plurality of subpixels SP. Consequently, the characteristics of the driver transistors DRT of some subpixels SP may be different from the characteristics of the driver transistors DRT of the remaining subpixels SP.

Due to the different characteristics of the plurality of driver transistors DRT provided in the display panel 110, the plurality of subpixels SP provided in the display panel 110 may have different luminous intensities. Thus, the display panel 110 may have non-uniformity in luminance.

Accordingly, the display device 100 according to embodiments of the present disclosure may provide a compensation function to sense characteristics of the driver transistors DRT by performing sensing driving to the subpixels SP of the display panel 110 and reduce differences in the characteristics of the driver transistors DRT. In this regard, hereinafter, two sensing driving methods will be described with reference to FIGS. 3 and 4.

Figure 3:
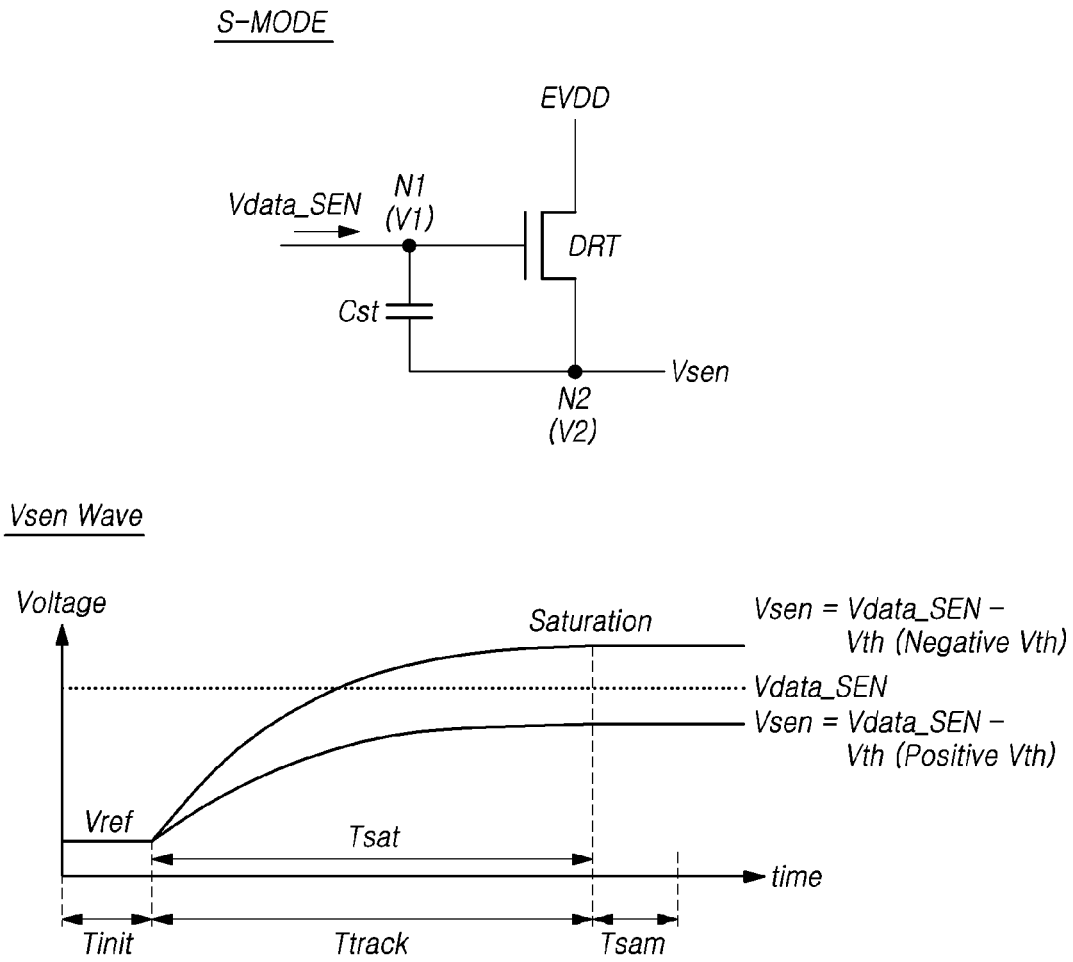
FIG. 3 is a diagram illustrating S-mode sensing driving of the display device according to embodiments of the present disclosure.
Figure 4:
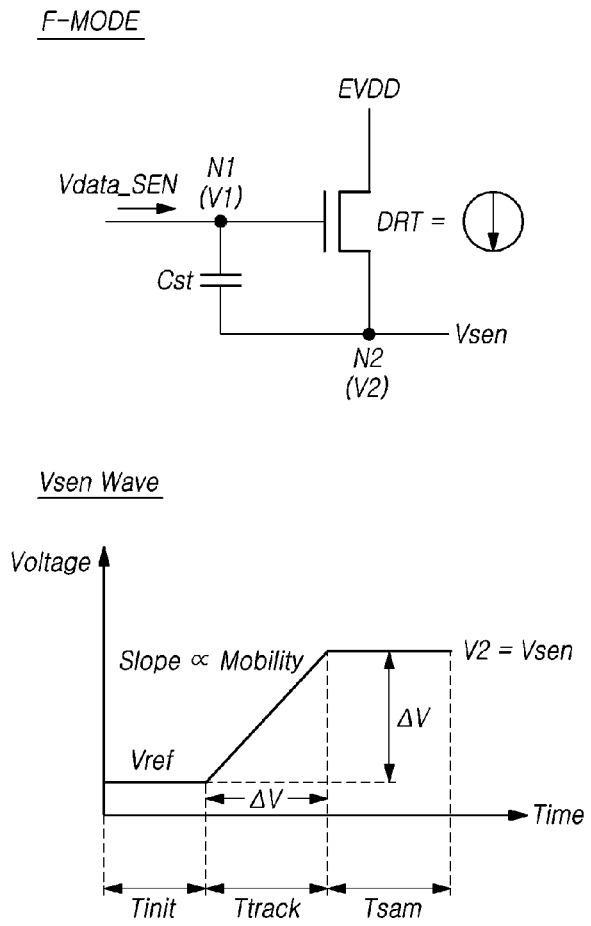
FIG. 4 is a diagram illustrating F-mode sensing driving of the display device according to embodiments of the present disclosure.

FIG. 3 is a diagram illustrating the sensing driving in slow mode (hereinafter, referred to as "S-mode") of the display device 100 according to embodiments of the present disclosure, and FIG. 4 is a diagram illustrating the sensing driving in fast mode (hereinafter, referred to as "F-mode") of the display device 100 according to embodiments of the present disclosure.

Referring to FIG. 3, in the S-mode, the subpixel SP is driven for an extended time in order to sense characteristics of the driver transistor DRT. Referring to FIG. 4, in the S-mode, the subpixel SP is driven for a short time in order to sense characteristics of the driver transistor DRT.

Referring to FIGS. 3 and 4, each of the sensing driving time of the S-mode and the sensing driving time of the F-mode may include an initialization time Tinit, a tracking time Ttrack, and a sampling time Tsam. Hereinafter, the sensing driving time of the S-mode and the sensing driving time of the F-mode will be described.

First, the sensing driving time of the S-mode of the display device 100 will be described with reference to FIG. 3.

Referring to FIG. 3, the initialization time Tinit of the sensing driving time of the S-mode is a period of time in which the first node N1 and the second node N2 of the driver transistor DRT are reset (or initialized). In the initialization time Tinit, the scan transistor SCT and the sensing transistor SENT may be turned on, and the power switch SPRE may be turned off.

The initialization time Tinit is a period of time in which a voltage V1 of the first node N1 of the driver transistor DRT is reset to a sensing driving data voltage Vdata_SEN and a voltage V2 of the second node N2 of the driver transistor DRT is reset to a sensing driving reference voltage Vref.

Referring to FIG. 3, the tracking time Ttrack of the sensing driving time of the S-mode is a period of time in which a voltage V2 of the second node N2 of the driver transistor DRT is boosted until the voltage V2 of the second node N2 of the driver transistor DRT reflects characteristics or changes in the characteristics of the driver transistor DRT.

During the tracking time Ttrack, the first node N1 of the driver transistor DRT is in a constant voltage state, whereas the voltage V2 of the second node N2 of the driver transistor DRT may reach a saturation point after having increased.

At the beginning of the tracking time Ttrack, the difference in the voltage between the first node N1 and the second node N2 of the driver transistor DRT reset during the initialization time Tinit may be equal to or greater than the threshold voltage Vth of the driver transistor DRT. In this case, the driver transistor DRT is turned on to allow current to flow therethrough. When the first node N1 and the second node N2 of the driver transistor DRT are the gate node and the source node, respectively, the difference in the voltage between the first node N1 and the second node N2 of the driver transistor DRT is Vgs. Thus, in a situation in which the difference in the voltage between the first node N1 and the second node N2 of the driver transistor DRT is equal to or greater than the threshold voltage Vth, the voltage V2 of the second node N2 of the driver transistor DRT may increase upon the beginning of the tracking time Ttrack.

For example, the characteristics of the driver transistor DRT may be the threshold voltage Vth of the driver transistor DRT. In this case, the voltage V2 of the second node N2 of the driver transistor DRT is changed until the voltage V2 of the second node N2 of the driver transistor DRT is in a voltage state reflecting the threshold voltage Vth or a change in the threshold voltage Vth.

Thus, the tracking time Ttrack is a period of time in which the voltage V2 of the second node N2 of the driver transistor DRT capable of reflecting the threshold voltage Vth or the change in the threshold voltage Vth of the driver transistor DRT is tracked.

In the tracking time Ttrack, the power switch SPRE or the sensing transistor SENT is turned off, thereby causing the second node N2 of the driver transistor DRT to float. Consequently, the voltage V2 of the second node N2 of the driver transistor DRT is caused to increase. The voltage V2 of the second node N2 of the driver transistor DRT does not continuously increase, but reaches a saturation point due to a decrease in the increment.

The saturated voltage V2 of the second node N2 of the driver transistor DRT may correspond to the difference Vdata-Vth between the data voltage Vdata and the threshold voltage Vth or the difference Vdata-ΔVth between the data voltage Vdata and the threshold voltage increment ΔVth.

When the voltage V2 of the second node N2 of the driver transistor DRT is saturated, the sampling time Tsam may start. The sampling time Tsam is a period of time in which the voltage Vdata-Vth or Vdata-ΔVth reflecting the voltage Vth or a change in the voltage Vth of the driver transistor DRT is measured.

During the sampling time Tsam of the sensing driving time of the S-mode, the ADC connected to the reference voltage line RVL senses the voltage of the reference voltage line RVL. Here, the voltage of the reference voltage line RVL may correspond to the voltage of the second node N2 of the driver transistor DRT and to a charged voltage of the line capacitor Crvl formed on the reference voltage line RVL.

During the sampling time Tsam, a voltage Vsen sensed by the ADC may be the voltage Vdata-Vth obtained by subtracting the threshold voltage Vth from the data voltage Vdata or the voltage Vdata-ΔVth obtained by subtracting the threshold voltage increment ΔVth from the data voltage Vdata. Here, Vth may be a positive threshold voltage or a negative threshold voltage.

During the tracking time Ttrack, a time Tsat taken for the voltage V2 of the second node N2 of the driver transistor DRT to reach the saturation point after having increased during the tracking time Ttrack is a time taken for the threshold voltage Vth or a change in the threshold voltage Vth of the driver transistor DRT to be reflected on the voltage V2=Vdata-Vth of the second node N2 of the driver transistor DRT. The time Tsat determines the overall time length of the sensing driving time of the S-mode.

In the S-mode, a significantly long time Tsat is taken for the voltage V2 of the second node N2 of the driver transistor DRT to increase to the saturation point. Thus, a sensing driving method of saturating the voltage V2 of the second node N2 of the driver transistor DRT by boosting the voltage V2 so that the voltage state of the second node N2 of the driver transistor DRT represents the characteristics of the driver transistor DRT is referred to as the slow mode (S-mode).

The sensing driving time of the F-mode of the display device 100 will be described with reference to FIG. 4.

Referring to FIG. 4, the initialization time Tinit of the sensing driving time of the F-mode is a period of time in which the first node N1 and the second node N2 of the driver transistor DRT are reset. During the initialization time Tinit, the scan transistor SCT and the sensing transistor SENT may be turned on, and the power switch SPRE may be turned on.

The initialization time Tinit is a period of time in which the voltage V1 of the first node N1 of the driver transistor DRT is reset to the sensing driving data voltage Vdata_SEN and the voltage V2 of the second node N2 of the driver transistor DRT is reset to the sensing driving reference voltage Vref.

Referring to FIG. 4, the tracking time Ttrack of the sensing driving time of the F-mode is a period of time in which the voltage V2 of the second node N2 of the driver transistor DRT is changed during a preset tracking time Δt until the voltage V2 of the second node N2 of the driver transistor DRT reaches a voltage state reflecting the characteristics or changes in the characteristics of the driver transistor DRT.

During the tracking time Ttrack, the preset tracking time Δt may be set to a short period of time. Thus, it is difficult for the voltage V2 of the second node N2 of the driver transistor DRT to reflect the threshold voltage Vth during the short tracking time Δt. Accordingly, the F-mode is a sensing driving method of sensing the mobility of the driver transistor DRT.

In the tracking time Ttrack, the power switch SPRE is turned off or the sensing transistor SENT is turned off, thereby causing the second node N2 of the driver transistor DRT to float. During the tracking time Ttrack, the scan transistor SCT may be in a turned-off state caused by the scan signal SCAN having a turn-off-level voltage, and the first node N1 of the driver transistor DRT may also be in a floated state.

At the beginning of the tracking time Ttrack, the difference in the voltage between the first node N1 and the second node N2 of the driver transistor DRT reset during the initialization time Tinit may be equal to or greater than the threshold voltage Vth of the driver transistor DRT. In this case, the driver transistor DRT may be turned on to allow current to flow therethrough. Here, when the first node N1 and the second node N2 of the driver transistor DRT are the gate node and the source node, respectively, the difference in the voltage between the first node N1 and the second node N2 of the driver transistor DRT is Vgs.

Thus, in a situation in which the difference in the voltage between the first node N1 and the second node N2 of the driver transistor DRT is equal to or greater than the threshold voltage Vth, when the tracking time Ttrack begins, the voltage V2 of the second node N2 of the driver transistor DRT may be boosted. At the same time, the voltage of the first node N1 of the driver transistor DRT may also be boosted.

During the tracking time Ttrack, the increase rate of the voltage V2 of the second node N2 of the driver transistor DRT varies depending on the current capability (i.e., mobility) of the driver transistor DRT. The greater the current capability (i.e., mobility) of the driver transistor DRT is, the faster the voltage V2 of the second node N2 of the driver transistor DRT may increase.

After the tracking time Ttrack has lasted for the preset tracking time Δt (e.g., after the voltage V2 of the second node N2 of the driver transistor DRT has increased for the preset tracking time Δt) the sampling time Tsam may follow. During the tracking time Ttrack, the increasing rate of the voltage V2 of the second node N2 of the driver transistor DRT corresponds to a voltage change ΔV during the preset tracking time Δt.

A voltage Vsen sensed by the ADC is a voltage that has increased from the reference voltage Vref by the voltage change ΔV for the preset tracking time Δt. The voltage Vsen corresponds to the mobility of the driver transistor DRT.

Referring to FIG. 4, in the sampling time Tsam of the sensing driving time of the F-mode, the voltage Vsen sensed by the ADC may vary depending on the mobility of the driver transistor DRT. The greater the mobility of the driver transistor DRT is, the higher the sensing voltage Vsen is. The smaller the mobility of the driver transistor DRT is, the lower the sensing voltage Vsen is.

During the tracking time Ttrack, the preset tracking time Δt may be set to a short period of time. In this sense, a sensing driving method of sampling the voltage V2 of the second node N2 of the driver transistor DRT by changing the voltage V2 of the second node N2 of the driver transistor DRT by the preset tracking time Δt is referred to as the fast mode (F-mode).

The display device 100 may find the threshold voltage Vth or a change in the threshold voltage Vth of the driver transistor DRT in a corresponding subpixel SP on the basis of the voltage Vsen sensed in the S-mode, calculate a threshold voltage compensation value by which threshold voltage differences among driver transistors DRT are reduced or removed, and store the calculated threshold voltage compensation value in a memory.

The display device 100 may find the mobility or a change in the mobility of the driver transistor DRT in the corresponding subpixel SP on the basis of the voltage Vsen sensed in the F-mode, calculate a mobility compensation value by which threshold voltage differences among driver transistors DRT are reduced or removed, and store the calculated mobility compensation value in the memory.

When the display device 100 supplies the data voltage Vdata for display driving to the corresponding subpixel SP, the display device 100 may supply the data voltage Vdata changed on the basis of the threshold voltage compensation value and the mobility compensation value.

As described above, the threshold voltage sensing is performed in the S-mode due to the feature requiring a longer sensing time, whereas the mobility sensing is performed in the F-mode due to the feature requiring a shorter sensing time.

Figure 5:
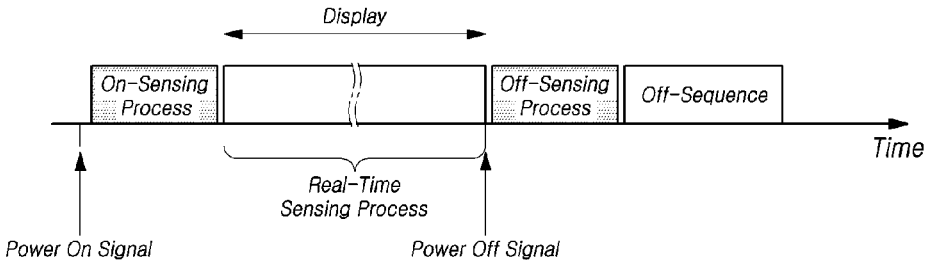
FIG. 5 is a diagram illustrating a variety of sensing points in time of the display device according to embodiments of the present disclosure.
Figure 6:
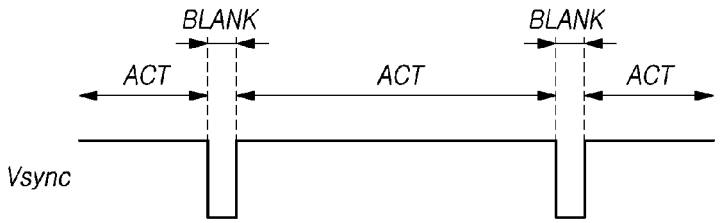
FIG. 6 is a diagram illustrating a vertical synchronization signal of the display device according to embodiments of the present disclosure.

FIG. 5 is a diagram illustrating a variety of sensing points in time of the display device 100 according to embodiments of the present disclosure, and FIG. 6 is a diagram illustrating a vertical synchronization signal Vsync of the display device 100 according to embodiments of the present disclosure.

Referring to FIG. 5, when a power on signal is generated, the display device 100 according to embodiments of the present disclosure may sense the characteristics of the driver transistor DRT in each of the subpixels SP provided in the display panel 110. This sensing process is referred to as the "on-sensing process".

In addition, when a power off signal is generated, before an off-sequence, such as power shut off, is performed, the display device 100 may sense the characteristics of the driver transistor DRT in each of the subpixels SP provided in the display panel 110. This sensing process is referred to as the "off-sensing process".

In addition, before the power off signal is generated after the generation of the power on signal, during the display driving, the display device 100 may sense the characteristics of the driver transistor DRT in each of the subpixels SP. This sensing process is referred to as the "real-time sensing process". The real-time sensing process may be performed during every blank period BLANK between active periods ACT on the basis of the vertical synchronization signal Vsync.

The sensing of the mobility of the driver transistor DRT may be performed for a short time in the F-mode, since only a shorter time is required.

Thus, the sensing of the mobility of the driver transistor DRT may be performed in the on-sensing process before the display driving in response to the power on signal being generated, may be performed in the off-sensing process during a section in which the display driving is not performed in response to the power off signal being generated, and may be performed in the real-time sensing process during every short blank period during the display driving.

In contrast, the sensing of the threshold voltage Vth of the driver transistor DRT requires a long voltage saturation time Vsat of the second node N2 of the driver transistor DRT. Thus, the sensing of the threshold voltage Vth of the driver transistor DRT may be performed in the S-mode for a longer period of time.

Thus, the sensing of the threshold voltage of the driver transistor DRT must be performed at points in time at which user's watching is not interrupted. Thus, the sensing of the threshold voltage of the driver transistor DRT may be performed while the display driving is not being performed (e.g., in a situation in which the user has no intention to watch) after the power off signal is generated by a user input or the like. That is, the sensing of the threshold voltage of the driver transistor DRT may be performed in the off-sensing process.

The threshold voltage Vth of the driver transistor DRT may change even in the display driving. Thus, in a situation in which the sensing of the threshold voltage of the driver transistor DRT is performed in the off-sensing process, when the threshold voltage is compensated for, the threshold voltage Vth changed during the display driving may not be reflected. Thus, deterioration in image quality may occur.

In addition, when the sensing of the threshold voltage of the driver transistor DRT is performed in the off-sensing process after the generation of the power off signal, the user does not perceive that the off-sensing process is being performed.

Accordingly, during the progression of the off-sensing process, the user may turn the display device 100 on again to watch or stop the supply of alternating current (AC) power by pulling out the power connector or the like. When this unexpected situation occurs, the off-sensing process is stopped, thereby making it impossible to sense of the threshold voltages of some or all of the driver transistors DRT. Consequently, the compensation is not performed, and thus, deterioration in image quality, such as an afterimage on the screen, may occur.

The present disclosure is intended to solve problems caused when the sensing of the threshold voltage of the driver transistor DRT is performed in the off-sensing process. Embodiments of the present disclosure propose a real-time threshold voltage compensation method and circuit based on F-mode sensing, the method and circuit being able to calculate an accurate threshold voltage compensation value by finely and incrementally correcting the threshold voltage compensation value in real time during the display driving, thereby ensuring that the threshold voltage is accurately and rapidly compensated for.

Figure 7:
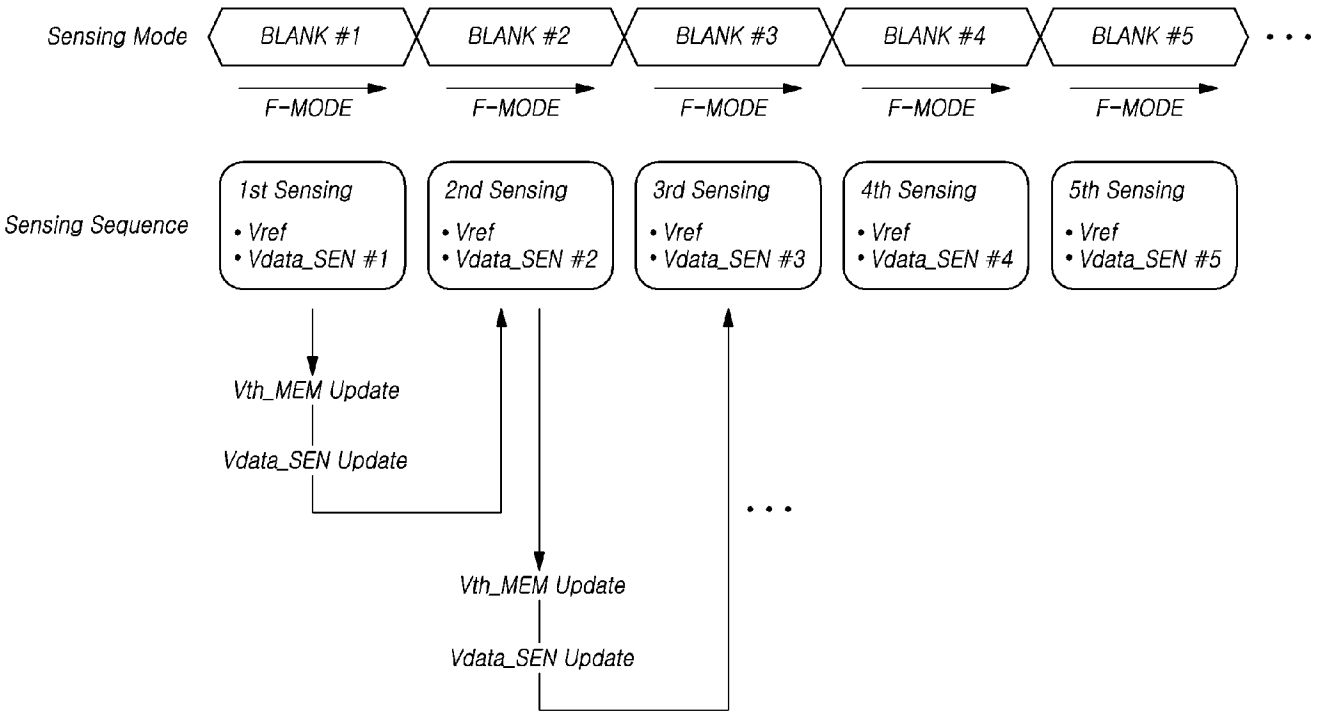
FIG. 7 is a diagram illustrating a method of compensating for the threshold voltage of a driver transistor in real time by performing the F-mode sensing driving in the display device according to embodiments of the present disclosure.

FIG. 7 is a diagram illustrating a method of compensating for the threshold voltage Vth of the driver transistor DRT in real time by performing the sensing driving in the F-mode (hereinafter, referred to as the "F-mode sensing driving") in the display device 100 according to embodiments of the present disclosure.

The display device 100 according to embodiments of the present disclosure may include: the display panel 110 including a plurality of data lines DL, a plurality of scan signal lines SCL, a plurality of sense signal lines SENL, a plurality of reference voltage lines RVL, and a plurality of subpixels SP; the data driver circuit 120 outputting data voltages Vdata to the plurality of data lines DL; the gate driver circuit 130 outputting scan signals SCAN to the plurality of scan signal lines SCL and outputting sense signals SENSE to the plurality of sense signal lines SENL; and the controller 140 controlling the data driver circuit 120 and the gate driver circuit 130. Each of the plurality of subpixels SP may include an emitting diode ED, a driver transistor DRT, and a storage capacitor Cst.

The display device 100 according to embodiments of the present disclosure may perform the sensing driving in the F-mode during the display driving and thus finely and incrementally correct a threshold voltage compensation value Vth_MEM in real time, thereby compensating for an actual threshold voltage Vth of the driver transistor DRT in real time. The actual threshold voltage Vth of the driver transistor DRT may be a depleted threshold voltage.

Referring to FIG. 7, the sensing driving in the F-mode for the real-time threshold voltage compensation may be performed during blank periods BLANK #1, BLANK #2, BLANK #3, BLANK #4, BLANK #5, and . . . . The blank periods BLANK #1, BLANK #2, BLANK #3, BLANK #4, BLANK #5, and . . . illustrated in FIG. 7 are not a series of continuous blank periods but are blank periods in each of which one arbitrary subpixel SP from among the plurality of subpixels SP is driven by the F-mode sensing driving.

Thus, blank periods BLANK, the number of which is equal to or less than the number of the subpixels in the display panel 110, may be present between the blank periods BLANK #1, BLANK #2, BLANK #3, BLANK #4, BLANK #5, and . . . illustrated in FIG. 7. For example, blank periods BLANK, the number of which is equal to or less than the number of the subpixels in the display panel 110, may be included between the first blank period BLANK #1 and the second blank period BLANK #2.

The F-mode sensing driving method for real-time threshold voltage compensation is fundamentally the same as the typical F-mode sensing driving method described above with reference to FIG. 4.

Here, during the initialization time Tinit of the sensing driving time of the F-mode for the real-time threshold voltage compensation, the sensing driving data voltage Vdata_SEN supplied to a corresponding subpixel SP may be updated and changed every time.

For example, during the initialization time Tinit of the sensing driving time of the F-mode performed during the first blank period BLANK #1, a first data voltage Vdata_SEN #1 for first sensing driving is supplied to a corresponding subpixel SP. During the initialization time Tinit of the sensing driving time of the F-mode performed during the second blank period BLANK #2 after the first blank period BLANK #1, a second data voltage Vdata_SEN #2 for second sensing driving, different from the first data voltage Vdata_SEN #1 for the first sensing driving, may be supplied to a corresponding subpixel SP. During the initialization time Tinit of the sensing driving time of the F-mode performed during the third blank period BLANK #3 after the second blank period BLANK #2, a third data voltage Vdata_SEN #3 for third sensing driving, different from the second data voltage Vdata_SEN #2 for the second sensing driving, may be supplied to a corresponding subpixel SP. During the initialization time Tinit of the sensing driving time of the F-mode performed during the fourth blank period BLANK #4 after the third blank period BLANK #3, a data voltage Vdata_SEN #4 for fourth sensing driving, different from the data voltage Vdata_SEN #3 for the third sensing driving, may be supplied to a corresponding subpixel SP. During the initialization time Tinit of sensing driving time of the F-mode performed during the fifth blank period BLANK #5 after the fourth blank period BLANK #4, a data voltage Vdata_SEN #5 for fifth sensing driving, different from the data voltage Vdata_SEN #4 for the fourth sensing driving, may be supplied to a corresponding subpixel SP.

Differently from the update of the sensing driving data voltage Vdata_SEN, the reference voltage Vref does not change. That is, during the initialization time Tinit of the sensing driving time of the F-mode for the real-time threshold voltage compensation, the reference voltage Vref supplied to the corresponding subpixel SP is the same every time.

Referring to FIG. 7, the F-mode sensing driving may be performed during each of the blank periods BLANK #1, BLANK #2, BLANK #3, BLANK #4, BLANK #5, and so on . . . and, according to the result of the F-mode sensing driving, the threshold voltage compensation value Vth_MEM may be updated. For example, the F-mode sensing driving may be performed during the first blank period BLANK #1 and, according to the result of the F-mode sensing driving, the threshold voltage compensation value Vth_MEM may be updated and stored. Afterwards, the F-mode sensing driving may be performed during the second blank period BLANK #2 and, according to the result of the F-mode sensing driving, the threshold voltage compensation value Vth_MEM may be updated and stored again.

Referring to FIG. 7, to perform the F-mode sensing driving, the sensing driving data voltage Vdata_SEN is updated according to the result of the sensing driving during the previous blank period BLANK. For example, the sensing driving data voltage Vdata_SEN for the F-mode sensing driving during the second blank period BLANK #2 may be updated according to the result of the F-mode sensing driving performed during the previous first blank period BLANK #1.

In addition, in the display driving, data is changed so that the threshold voltage compensation may be actually applied. Here, the threshold voltage compensation value Vth_MEM may be referred to. For example, in the case of the data voltage Vdata for the display driving to be supplied to the corresponding subpixel SP, a data voltage changed for the application of the threshold voltage compensation may be a voltage Vdata+Vth_MEM obtained by adding the threshold voltage compensation value Vth_MEM to the original data voltage Vdata.

Hereinafter, a real-time threshold voltage compensation method and a real-time threshold voltage compensation circuit based on the F-mode sensing briefly described above will be described in more detail.

Figure 8:
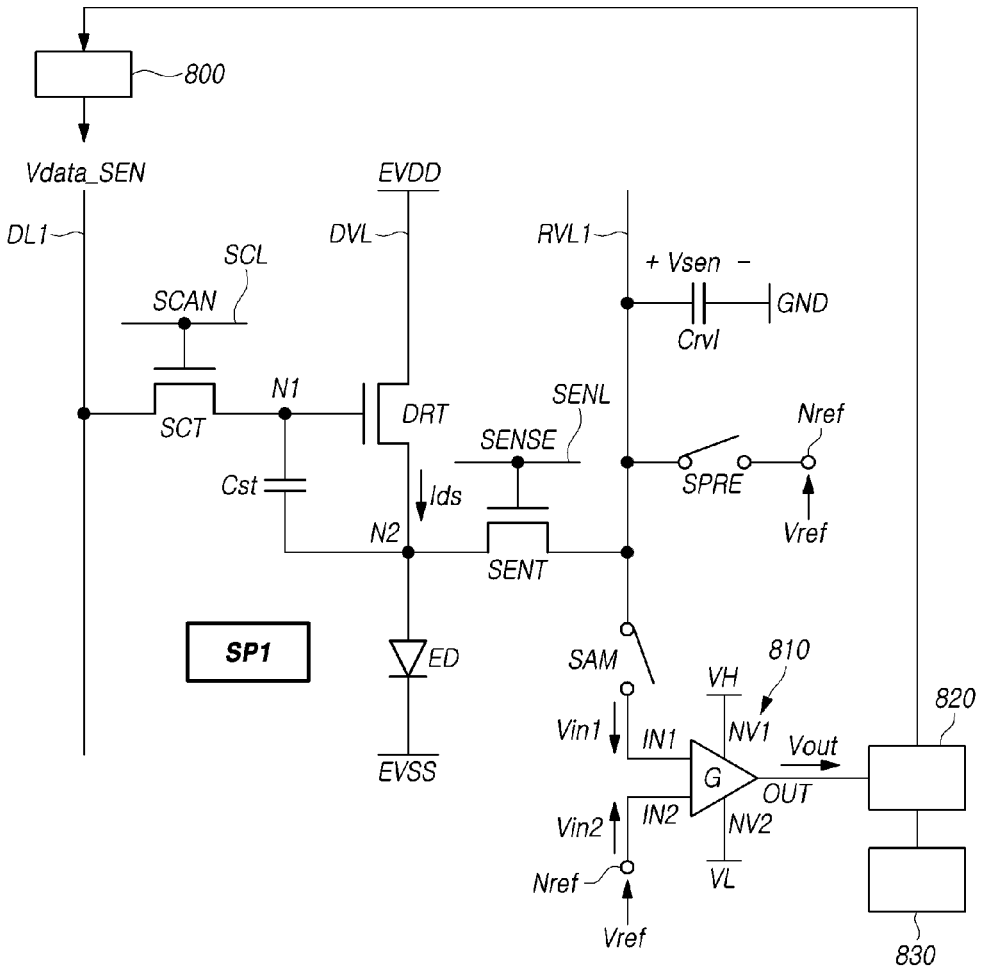
FIG. 8 is a diagram illustrating a real-time threshold voltage compensation circuit based on F-mode sensing in the display device according to embodiments of the present disclosure.
Figure 9:
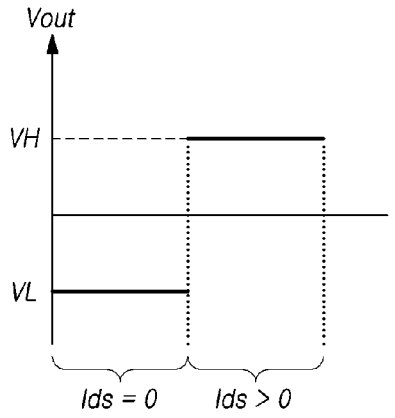
FIG. 9 is a diagram illustrating a comparator included in the real-time threshold voltage compensation circuit based on the F-mode sensing in the display device according to embodiments of the present disclosure.
Figure 10:
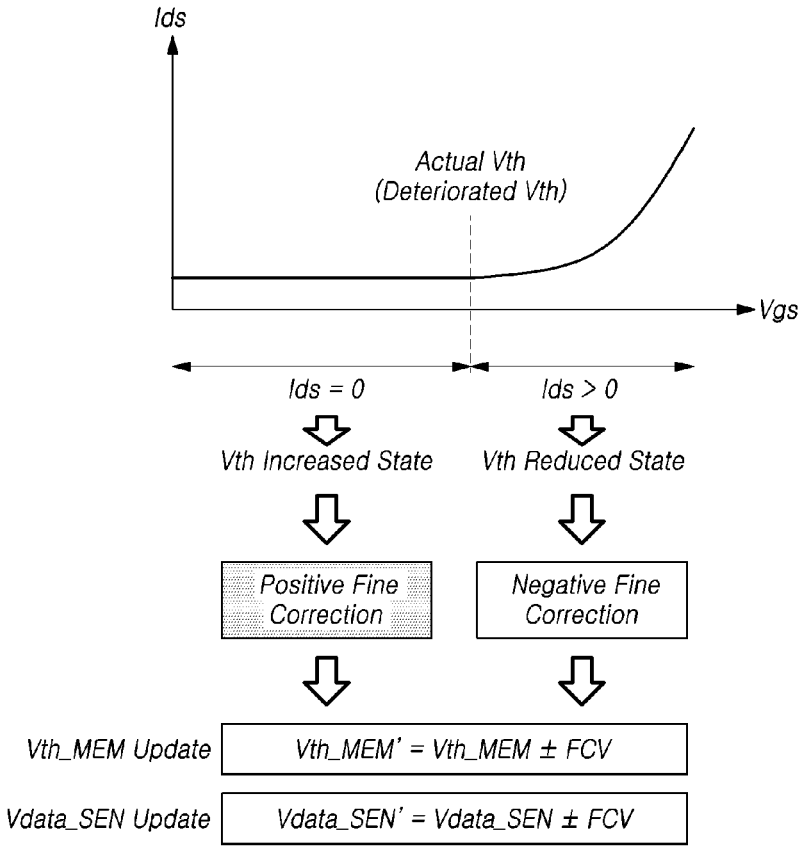
FIG. 10 is a diagram illustrating fine correction depending on whether or not a current flows through a driver transistor for real-time threshold voltage compensation based on the F-mode sensing in the display device according to embodiments of the present disclosure.
Figure 11:
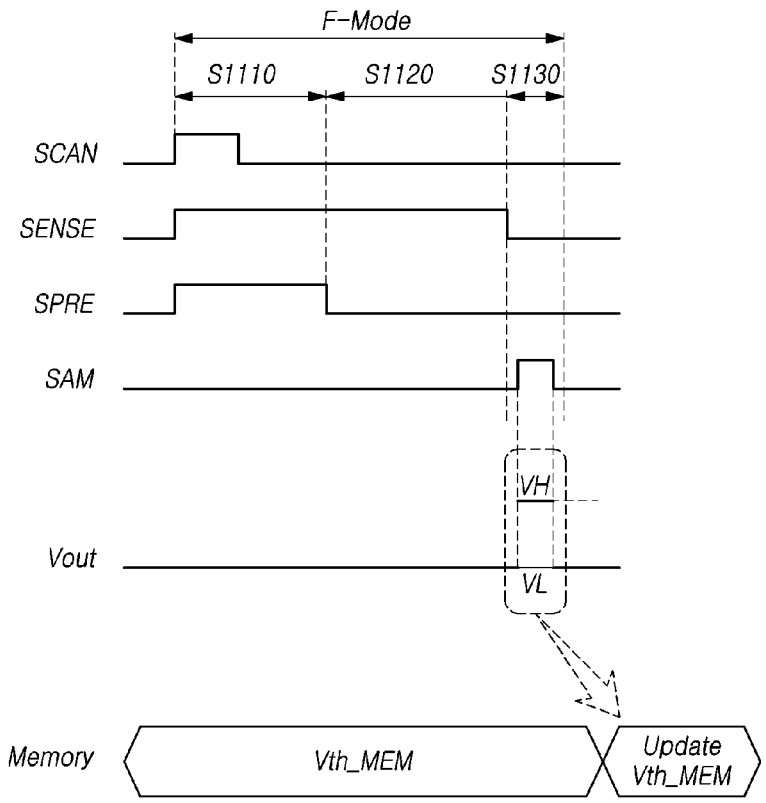
FIG. 11 is a diagram illustrating driving timing for the F-mode sensing driving during a single blank period in the display device according to embodiments of the present disclosure.

FIG. 8 is a diagram illustrating the real-time threshold voltage compensation circuit based on the F-mode sensing in the display device 100 according to embodiments of the present disclosure, FIG. 9 is a diagram illustrating a comparator 810 included in the real-time threshold voltage compensation circuit based on the F-mode sensing in the display device 100 according to embodiments of the present disclosure, FIG. 10 is a diagram illustrating fine correction depending on whether or not a current flow through a driver transistor for the real-time threshold voltage compensation based on the F-mode sensing in the display device according to embodiments of the present disclosure, and FIG. 11 is a diagram illustrating driving timing for the F-mode sensing driving during a single blank period in the display device 100 according to embodiments of the present disclosure.

Referring to FIG. 8, a first subpixel SP1 will be taken from among the plurality of subpixels SP in order to describe the real-time threshold voltage compensation based on the F-mode sensing.

Referring to FIG. 8, the first subpixel SP1 from among the plurality of subpixels SP provided in the display panel 110 may be connected to a first data line DL1 from among the plurality of data lines DL and to a first reference voltage line RVL1 from among the plurality of reference voltage lines RVL.

Referring to FIG. 8, the arbitrarily-selected first subpixel SP1 may include: an emitting diode ED; a driver transistor DRT driving the emitting diode ED; a scan transistor SCT controlled by a scan signal SCAN and controlling the connection between first node N1 of the driver transistor DRT and the first data line DL1; a sensing transistor SENT controlled by a sense signal SENSE and controlling the connection between the second node N2 of the driver transistor DRT and the first reference voltage line RVL1; and a storage capacitor Cst electrically connected to a first node N1 and a second node N2 of the driver transistor DRT.

Referring to FIG. 8, in the display device 100 according to embodiments of the present disclosure, the real-time threshold voltage compensation circuit based on the F-mode sensing may include a power switch SPRE, a sampling switch SAM, a comparator 810, a compensation controller 820, a memory 830, a data voltage output circuit 800, and the like, in addition to the subpixel circuit.

For example, the power switch SPRE, the sampling switch SAM, and the comparator 810 may be included within the data driver circuit 120. The compensation controller 820 may be included within the controller 140.

Referring to FIG. 8, the power switch SPRE may control the connection between the first reference voltage line RVL1 and the reference voltage supply node Nref. The sampling switch SAM may control the connection between the comparator 810 and the first reference voltage line RVL1.

Referring to FIG. 8, the comparator 810 may include a first input terminal IN1, a second input terminal IN2, and an output terminal OUT. In the comparator 810, the input terminal IN1 is a node through which a voltage from the first reference voltage line RVL1 is input, and the second input terminal IN2 is a node electrically connected to the reference voltage supply node Nref. The output terminal OUT of the comparator 810 may serve to output a first output voltage or a second output voltage less than the first output voltage as an output signal Vout.

Referring to FIGS. 8 and 9, when a first input voltage Vin1 of the input terminal IN1 is greater than a second input voltage Vin2 of the second input terminal IN2, the first output voltage serving as the output signal Vout of the comparator 810 is the voltage of the output signal Vout output from the output terminal OUT of the comparator 810.

Referring to FIGS. 8 and 9, when the first input voltage Vin1 of the input terminal IN1 is less than the second input voltage Vin2 of the second input terminal IN2, the second output voltage serving as the output signal Vout of the comparator 810 is the voltage of the output signal Vout output from the output terminal OUT of the comparator 810.

Referring to FIGS. 8 and 9, the output signal Vout of the comparator 810 is a value Vout=G X (Vin1-Vin2) obtained by multiplying a difference between the first input voltage Vin1 of the input terminal IN1 and the second input terminal IN2 of the second input terminal IN2 with a gain G.

The comparator 810 may further include a first supply input terminal NV1 through which a first supply voltage VH is input and a second supply input terminal NV2 through which a second supply voltage VL is input. Here, the second supply voltage VL may be a supply voltage less than the first supply voltage VH.

The gain G of the comparator 810 may theoretically be a limitless value and substantially a significantly large value. Thus, the first output voltage of the comparator 810 may be the same as the first supply voltage VH and the second output voltage of the comparator 810 may be the same as the second supply voltage VL. That is, the comparator 810 may have the gain G causing the first output voltage to be the same as the first supply voltage VH and the second output voltage to be the same as the second supply voltage VL.

Referring to FIG. 8, the sampling switch SAM may control the connection between the input terminal IN1 and the first reference voltage line RVL1 of the comparator 810.

Referring to FIG. 8, the memory 830 is a storage medium storing the threshold voltage compensation value Vth_MEM regarding the driver transistor DRT in the first subpixel SP1. For example, the memory 830 may be a double data rate (DDR) memory or the like.

Referring to FIG. 8, the compensation controller 820 may control the F-mode sensing driving and perform fine correction (i.e., fine adjustment) of the threshold voltage compensation value Vth_MEM.

Referring to FIGS. 8 and 10, the compensation controller 820 may obtain the output signal Vout of the comparator 810 according to the result of the F-mode sensing driving during the first blank period BLANK #1 and, on the basis of the obtained output signal Vout, determine whether or not a current Ids is allowed to flow by the driver transistor DRT.

The compensation controller 820 may obtain the output signal Vout of the comparator 810 according to the result of the F-mode sensing driving during the first blank period BLANK #1 and, when the obtained output signal Vout is the first output voltage VH, determine that the current Ids is allowed to flow by the driver transistor DRT (e.g., Ids>0). Here, when the current Ids is allowed to flow by the driver transistor DRT, the voltage difference Vgs between the gate node N1 and the source node N2 of the driver transistor DRT may be equal to or greater than the actual threshold voltage Vth.

The compensation controller 820 may obtain the output signal Vout of the comparator 810 according to the result of the F-mode sensing driving during the first blank period BLANK #1 and, when the obtained output signal Vout is the second output voltage VL, determine that the current Ids is not allowed to flow by the driver transistor DRT (e.g., Ids=0). Here, when the current Ids is not allowed to flow by the driver transistor DRT, the voltage difference Vgs between the gate node N1 and the source node N2 of the driver transistor DRT may be less than the actual threshold voltage Vth.

Referring to FIGS. 8 and 10, the compensation controller 820 may determine whether positive fine correction or negative fine correction is necessary for the threshold voltage compensation value Vth_MEM, according to the result of determining whether or not the current is allowed to flow by the driver transistor DRT during the F-mode sensing driving during the first blank period BLANK #1.

When it is determined that the current Ids is allowed to flow by the driver transistor DRT (i.e., Ids>0), the compensation controller 820 may determine that the actual threshold voltage Vth of the driver transistor DRT is reduced to be less than the threshold voltage Vth_MEM stored in the memory 830 and determine the negative fine correction for the threshold voltage compensation value Vth_MEM to be necessary.

When it is determined that the current Ids is not allowed to flow by the driver transistor DRT (e.g., Ids=0), the compensation controller 820 may determine that the actual threshold voltage Vth of the driver transistor DRT is increased to be greater than the threshold voltage Vth_MEM stored in the memory 830 or is not changed and determine the positive fine correction for the threshold voltage compensation value Vth_MEM to be necessary.

When the negative fine correction for the threshold voltage compensation value Vth_MEM is determined to be necessary, the compensation controller 820 may update the threshold voltage compensation value Vth_MEM stored in the memory 830 by subtracting a fine correction value FCV from the threshold voltage compensation value Vth_MEM stored in the memory 830. Consequently, a threshold voltage compensation value Vth_MEM' updated and stored in the memory 830 according to the result of the F-mode sensing driving during the first blank period BLANK #1 may be a value Vth_MEM−FCV obtained by subtracting the fine correction value FCV from the non-updated threshold voltage compensation value Vth_MEM. Here, the preset fine correction value FCV may be a minimum value that can be set in hardware or may be a fixed value. For example, the fine correction value FCV may be a minimum voltage that can be set by an IC corresponding to the data driver circuit 120 or may be a minimum voltage beat that can be set by the controller 140.

When the positive fine correction for the threshold voltage compensation value Vth_MEM is determined to be necessary, the compensation controller 820 may update the threshold voltage compensation value Vth_MEM stored in the memory 830 by adding the fine correction value FCV to the threshold voltage compensation value Vth_MEM stored in the memory 830. Thus, the threshold voltage compensation value Vth_MEM' updated and stored in the memory 830 according to the result of the F-mode sensing driving during the first blank period BLANK #1 may be a value Vth_MEM+FCV obtained by adding the fine correction value FCV to the non-updated threshold voltage compensation value Vth_MEM.

Referring to FIGS. 8 and 10, the compensation controller 820 may determine the sensing driving second data voltage Vdata_SEN #2 for the F-mode sensing driving during the second blank period BLANK #2, on the basis of the result of the F-mode sensing driving during the first blank period BLANK #1.

In the update of the threshold voltage compensation value Vth_MEM, when the negative fine correction is performed, the sensing driving data voltage Vdata_SEN may be reduced. Specifically, in the update of the threshold voltage compensation value Vth_MEM, when the negative fine correction is performed, the sensing driving second data voltage Vdata_SEN #2 for the F-mode sensing driving during the second blank period BLANK #2 may be a voltage Vdata_SEN #1-FCV obtained by subtracting the fine correction value FCV from the sensing driving first data voltage Vdata_SEN #1 for the F-mode sensing driving during the first blank period BLANK #1.

In the update of the threshold voltage compensation value Vth_MEM, when the positive fine correction is performed, the sensing driving data voltage Vdata_SEN may be increased. Specifically, in the update of the threshold voltage compensation value Vth_MEM, when the positive fine correction is performed, the sensing driving second data voltage Vdata_SEN #2 for the F-mode sensing driving during the second blank period BLANK #2 may be a voltage Vdata_SEN #1+FCV obtained by adding the fine correction value FCV to the sensing driving first data voltage Vdata_SEN #1 for the F-mode sensing driving during the first blank period BLANK #1.

Referring to FIG. 8, the real-time threshold voltage compensation circuit may further include the data voltage output circuit 800 outputting the sensing driving data voltage Vdata_SEN to each of the plurality of data lines DL or outputting image display data voltages Vdata to the plurality of data lines DL. Here, the data voltage output circuit 800 may include a latch circuit, a digital-to-analog converter (DAC), an output buffer, and the like.

The first blank period BLANK #1 and the second blank period BLANK #2 described above are two blank periods BLANK in which the F-mode sensing driving for the first subpixel SP1 is performed. Blank periods BLANK, the number of which is equal to or less than the number of the subpixels SP provided in the display panel 110, may be present between the first blank period BLANK #1 and the second blank period BLANK #2.

The F-mode sensing driving for the first subpixel SP1 is performed during the first blank period BLANK #1 and, after the first blank period BLANK #1, the F-mode sensing driving for the remaining subpixels SP is performed during each of the blank periods BLANK. Afterwards, during the second blank period BLANK #2, the F-mode sensing driving for the first subpixel SP1 may be performed.

The number of blank periods BLANK present between the first blank period BLANK #1 and the second blank period BLANK #2 may increase according to the resolution and the number of the subpixels of the display panel 110 and may decrease according to the number of the subpixels receiving the reference voltage Vref from a single reference voltage line RVL.

Referring to FIG. 11, the sensing driving time of the F-mode for the first subpixel SP1 during the first blank period BLANK #1 may include an initialization period S1110, a tracking period S1120, and a sampling period S1130.

Referring to FIG. 11, the initialization period S1110 of the sensing driving time of the F-mode performed during the first blank period BLANK #1 is a period of time in which the first node N1 and the second node N2 of the driver transistor DRT are reset. During the initialization period S1110, the scan transistor SCT may be turned on by the scan signal SCAN having a turn-on-level voltage, the sensing transistor SENT may be turned on by the sense signal SENSE having a turn-on-level voltage, and the power switch SPRE may be turned on.

During the initialization period S1110, the sensing driving first data voltage Vdata_SEN #1 supplied through the first data line DL1 is applied to the first node N1 of the driver transistor DRT through the turned-on scan transistor SCT. During the initialization period S1110, the reference voltage Vref supplied to the first reference voltage line RVL1 through the turned-on power switch SPRE is applied to the second node N2 of the driver transistor DRT.

Thus, during the initialization period S1110, the first node N1 of the driver transistor DRT may be reset to the first data voltage Vdata_SEN #1, and the second node N2 of the driver transistor DRT may be reset to the reference voltage Vref.

Referring to FIG. 11, during the tracking period S1120 in the sensing driving time of the F-mode performed during the first blank period BLANK #1, the scan transistor SCT may be turned off by the scan signal SCAN having a turn-off-level voltage, the power switch SPRE may be turned off, and the sensing transistor SENT may remain turned-on.

During the tracking period S1120, the first node N1 of the driver transistor DRT may be floated by the turning off of the scan transistor SCT, and the second node N2 of the driver transistor DRT may be floated by the turning off of the power switch SPRE.

At the beginning of the tracking period S1120, the voltage difference Vgs between the first node N1 and the second node N2 of the driver transistor DRT reset during the initialization period S1110 may be equal to or greater than the actual threshold voltage Vth of the driver transistor DRT. In this case, the driver transistor DRT is turned on to allow the current Ids to flow therethrough. Here, when the first node N1 and the second node N2 of the driver transistor DRT are the gate node and the source node, respectively, the difference in the voltage between the first node N1 and the second node N2 of the driver transistor DRT is Vgs.

Thus, in a situation in which the difference in the voltage between the first node N1 and the second node N2 of the driver transistor DRT is equal to or greater than threshold voltage Vth, when the tracking period S1120 begins, the voltage of the second node N2 of the driver transistor DRT may be boosted. At the same time, the voltage of the first node N1 of the driver transistor DRT may also be boosted.

As the current flows through the driver transistor DRT, the line capacitor Crvl of the first reference voltage line RVL1 is charged. Consequently, the voltage of the second node N2 of the driver transistor DRT and the voltage of the first reference voltage line RVL1 are simultaneously increased. In this state, the second node N2 of the driver transistor DRT and the first reference voltage line RVL1 remain electrically connected by the turned on sensing transistor SENT.

In addition, at the beginning of the tracking period S1120, the voltage difference Vgs between the first node N1 and the second node N2 of the driver transistor DRT reset during the initialization period S1110 may be less than the actual threshold voltage Vth of the driver transistor DRT. In this case, the driver transistor DRT is turned off. Consequently, no current flows through the driver transistor DRT.

Thus, in a situation in which the difference in the voltage between the first node N1 and the second node N2 of the driver transistor DRT is less than the threshold voltage Vth, when the tracking period S1120 begins, the voltage of the second node N2 of the driver transistor DRT is not boosted.

When a predetermined time has passed after the beginning of the tracking period S1120, the sampling period S1130 may begin. During the sampling period S1130 of the sensing driving time of the F-mode performed during the first blank period BLANK #1, the sampling switch SAM is turned on, so that the voltage of the first reference voltage line RVL1 is input to the input terminal IN1 of the comparator 810.

The voltage of the first reference voltage line RVL1 input to the input terminal IN1 of the comparator 810 may be a voltage (e.g., a voltage greater than Vref) boosted during the tracking period S1120 (Vgs≥Vth) or a voltage Vref not boosted during the tracking period S1120 (Vgs<Vth), depending on the magnitude (e.g., the degree of deterioration) of the actual threshold voltage Vth of the driver transistor DRT.

Thus, the comparator 810 may compare the voltage of the first reference voltage line RVL1 input to the input terminal IN1 with the reference voltage Vref input to the second input terminal IN2 and output the first supply voltage VH or the second supply voltage VL as the output signal Vout according to the result of the comparison.

When the voltage of the first reference voltage line RVL1 input to the input terminal IN1 is greater than the reference voltage Vref input to the second input terminal IN2, the comparator 810 may output the first output voltage VH as the output signal Vout.

When the voltage of the first reference voltage line RVL1 input to the input terminal IN1 is equal to or less than the reference voltage Vref input to the second input terminal IN2, the comparator 810 may output the second output voltage VL as the output signal Vout.

The compensation controller 820 may obtain the output signal Vout of the comparator 810 according to the result of the F-mode sensing driving during the first blank period BLANK #1 and, when the obtained output signal Vout is the first supply voltage VH, determine that the current Ids is allowed to flow by the driver transistor DRT (e.g., Ids>0). Here, when the current Ids is allowed to flow by the driver transistor DRT, the voltage difference Vgs between the gate node N1 and the source node N2 of the driver transistor DRT is equal to or greater than the actual threshold voltage Vth.

The compensation controller 820 may obtain the output signal Vout of the comparator 810 according to the result of the F-mode sensing driving during the first blank period BLANK #1 and, when the obtained output signal Vout is the second supply voltage VL, determine that the current Ids is not allowed to flow by the driver transistor DRT (e.g., Ids=0). Here, when the current Ids is not allowed to flow by the driver transistor DRT, the voltage difference Vgs between the gate node N1 and the source node N2 of the driver transistor DRT is less than the actual threshold voltage Vth.

As described above, the compensation controller 820 may update the threshold voltage compensation value Vth_MEM stored in the memory 830 by determining whether the positive fine correction or the negative fine correction is necessary for the threshold voltage compensation value Vth_MEM, according to the result of determining whether or not the current is allowed to flow by the driver transistor DRT during the F-mode sensing driving during the first blank period BLANK #1.

The data driver circuit 120 may output the first data voltage Vdata_SEN #1 to the first data line DL1 for the F-mode sensing driving for the first subpixel SP1 during the first blank period BLANK #1.

The data driver circuit 120 may output the second data voltage Vdata_SEN #2 to the first data line DL1 for the F-mode sensing driving for the first subpixel SP1 during the second blank period BLANK #2 after the first blank period BLANK #1. Here, the second data voltage Vdata_SEN #2 may have a different voltage value from the first data voltage Vdata_SEN #1.

The second data voltage Vdata_SEN #2 (i.e., the sensing driving data voltage Vdata_SEN supplied to the first data line DL1 during the second blank period BLANK #2) may be set different from the first data voltage Vdata_SEN #1 depending on whether or not the current is allowed to flow by the driver transistor DRT during the first blank period BLANK #1.

The first data voltage Vdata_SEN #1 is the sensing driving data voltage Vdata_SEN supplied to the first subpixel SP1 during the first blank period BLANK #1.

When the current Ids flows through the driver transistor DRT in the first subpixel SP1 during the first blank period BLANK #1, the second data voltage Vdata_SEN #2 supplied to the first data line DL1 during the second blank period BLANK #2 may be set less than the first data voltage Vdata_SEN #1.

In contrast, when the current Ids does not flow through the driver transistor DRT in the first subpixel SP1 during the first blank period BLANK #1, the second data voltage Vdata_SEN #2 supplied to the first data line DL1 during the second blank period BLANK #2 may be set greater than the first data voltage Vdata_SEN #1.

When the current Ids flows through the driver transistor DRT in the first subpixel SP1 during the first blank period BLANK #1, the negative fine correction is necessary. Thus, when the current Ids flows through the driver transistor DRT in the first subpixel SP1 during the first blank period BLANK #1, the second data voltage Vdata_SEN #2 is a voltage obtained by subtracting the preset fine correction value FCV from the first data voltage Vdata_SEN #1, i.e., Vdata_SEN #2=Vdata_SEN #1-FCV.

When the current Ids does not flow through the driver transistor DRT in the first subpixel SP1 during the first blank period BLANK #1, the positive fine correction is necessary. Thus, when the current Ids does not flow through the driver transistor DRT in the first subpixel SP1 during the first blank period BLANK #1, the second data voltage Vdata_SEN #2 is a voltage obtained by adding the preset fine correction value FCV to the first data voltage Vdata_SEN #1, i.e., Vdata_SEN #2=Vdata_SEN #1+FCV.

When the current Ids flows through the driver transistor DRT in the first subpixel SP1 during the first blank period BLANK #1, the compensation controller 820 may recognize the flow of the current Ids by the output signal Vout from the comparator 810 and update the threshold voltage compensation value Vth_MEM stored in the memory 830 so as to be reduced by the preset fine correction value FCV.

When the current Ids does not flow through the driver transistor DRT in the first subpixel SP1 during the first blank period BLANK #1, the compensation controller 820 may recognize the non-flow of the current Ids by the output signal Vout from the comparator 810 and update the threshold voltage compensation value Vth_MEM stored in the memory 830 so as to be increased by the preset fine correction value FCV.

During the first active period ACT after the first blank period BLANK #1, the data driver circuit 120 may supply an image data voltage, converted according to the threshold voltage compensation value Vth_MEM updated in the memory 830, to the first subpixel SP1 through the first data line DL1

Figure 12:
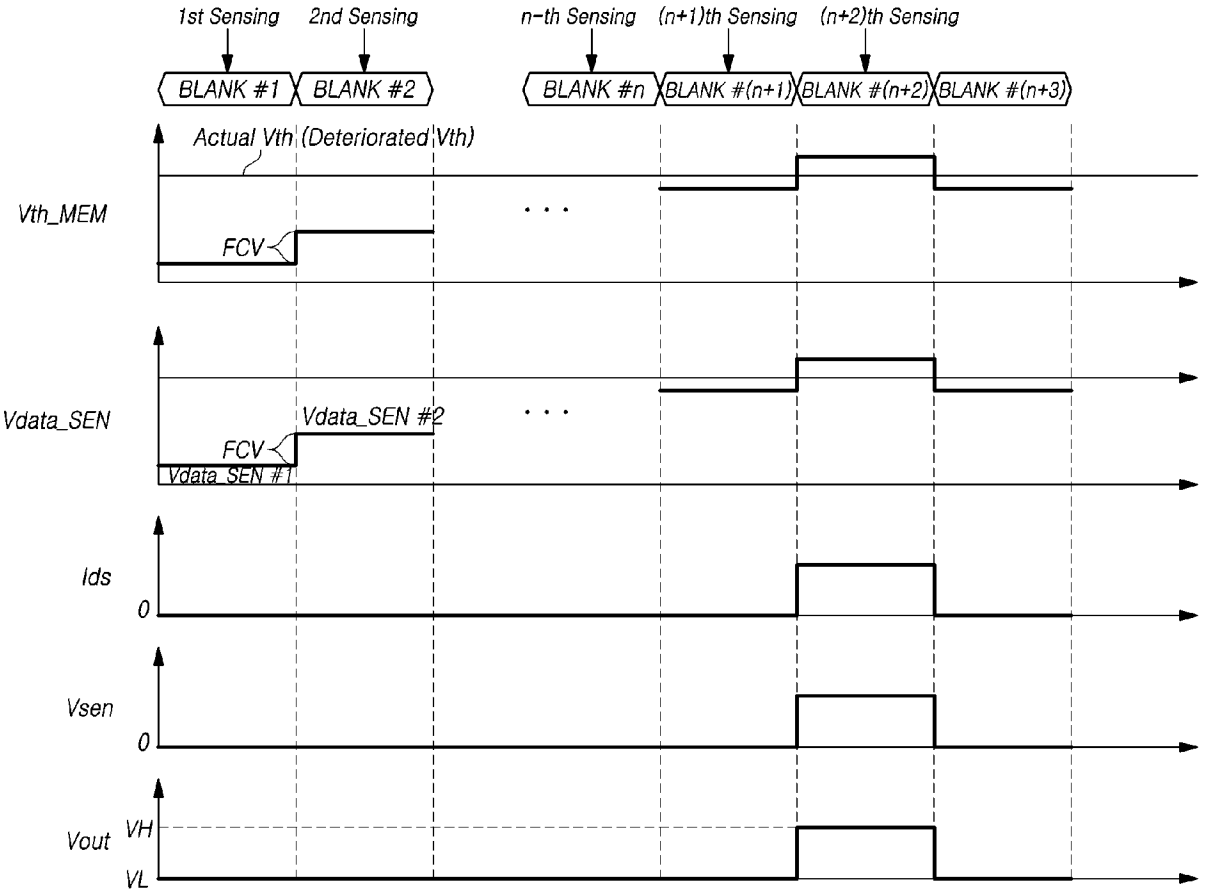
FIG. 12 is a diagram illustrating driving timing when the F-mode sensing driving is repeatedly performed during each of a plurality of blank periods in the display device according to embodiments of the present disclosure.

FIG. 12 is a diagram illustrating driving timing when the F-mode sensing driving is repeatedly performed for the first subpixel SP1 during each of a plurality of blank periods BLANK #1, BLANK #2, . . . , BLANK #n, BLANK #(n+1), BLANK #(n+2), BLANK #(n+3), and . . . in the display device 100 according to embodiments of the present disclosure.

In FIG. 12, a situation in which the threshold voltage compensation value Vth_MEM stored in the memory 830 before the first blank period BLANK #1 is less than the actual threshold voltage Vth of the driver transistor DRT in the first subpixel SP1 will be taken as an example.

During the first blank period BLANK #1, when the display device 100 performs the F-mode sensing driving using the first data voltage Vdata_SEN #1, the current Ids does not flow through the driver transistor DRT. Thus, the voltage of the first reference voltage line RVL1 is maintained as the reference voltage Vref (e.g., 0V) applied to the first reference voltage line RVL1 during the initialization period S1110, and thus, the reference voltage Vref (e.g., 0V) is input as the sensing voltage Vsen to the input terminal IN1 of the comparator 810. Consequently, the positive fine correction is performed. Accordingly, the threshold voltage compensation value Vth_MEM stored in the memory 830 is increased by the fine correction value FCV.

During the second blank period BLANK #2, when the display device 100 performs the F-mode sensing driving using the second data voltage Vdata_SEN #2 greater than the first data voltage Vdata_SEN #1 by the fine correction value FCV, the current Ids does not flow through the driver transistor DRT. Thus, the voltage of the first reference voltage line RVL1 is maintained as the reference voltage Vref (e.g., 0V) applied to the first reference voltage line RVL1 during the initialization period S1110, and thus, the reference voltage Vref (e.g., 0V) is input as the sensing voltage Vsen to the input terminal IN1 of the comparator 810. Consequently, the positive fine correction is performed. Accordingly, the threshold voltage compensation value Vth_MEM stored in the memory 830 is increased by the fine correction value FCV.

As described above, during the (n+1)th blank period BLANK #(n+1), when the display device 100 performs the F-mode sensing driving using the (n+1)th data voltage Vdata_SEN #(n+1) greater than the nth data voltage Vdata_SEN #n by the fine correction value FCV, the current Ids does not flow through the driver transistor DRT. Thus, the voltage of the first reference voltage line RVL1 is maintained as the reference voltage Vref (e.g., 0V) applied to the first reference voltage line RVL1 during the initialization period S1110, and thus, the reference voltage Vref (e.g., 0V) is input as the sensing voltage Vsen to the input terminal IN1 of the comparator 810. Consequently, the positive fine correction is performed. Accordingly, the threshold voltage compensation value Vth_MEM stored in the memory 830 is increased by the fine correction value FCV. Here, the threshold voltage compensation value Vth_MEM updated and stored as above is greater than the actual threshold voltage Vth.

During the (n+2)th blank period BLANK #(n+2), when the display device 100 performs the F-mode sensing driving using the (n+2)th data voltage Vdata_SEN #(n+2) greater than the (n+1)th data voltage Vdata_SEN #(n+1) by the fine correction value FCV, the current Ids may flow through the driver transistor DRT. Thus, the voltage of the first reference voltage line RVL1 increases, and thus, the increased voltage is input as the sensing voltage Vsen to the input terminal IN1 of the comparator 810. Consequently, the negative fine correction is performed. Accordingly, the threshold voltage compensation value Vth_MEM stored in the memory 830 is reduced by the fine correction value FCV. Here, the threshold voltage compensation value Vth_MEM updated and stored is reduced again to be less than the actual threshold voltage Vth.

As the F-mode sensing driving is repeatedly performed during every blank period BLANK in the above-described manner, the threshold voltage compensation value Vth_MEM stored in the memory 830 is finely and incrementally corrected so as to approximate to the actual threshold voltage Vth of the driver transistor DRT. Thus, in the image display driving, accurate compensation processing may be performed using the accurate threshold voltage compensation value Vth_MEM.

Figure 13:
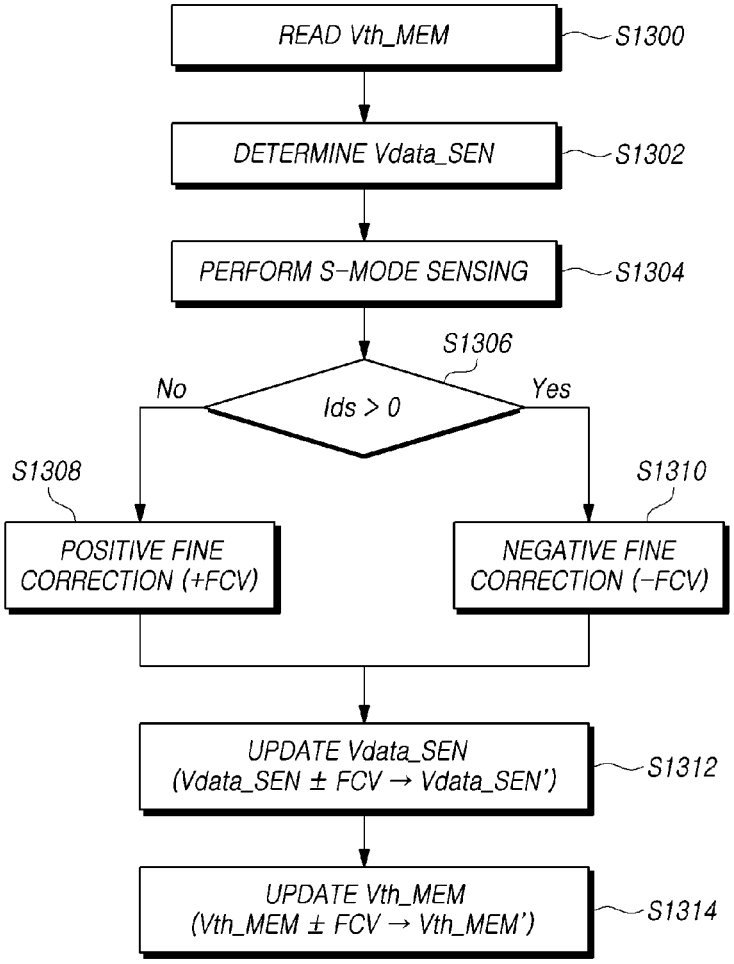
FIG. 13 is a flowchart illustrating a real-time threshold voltage compensation method on the basis of the F-mode sensing of the display device according to embodiments of the present disclosure.
Figure 14:
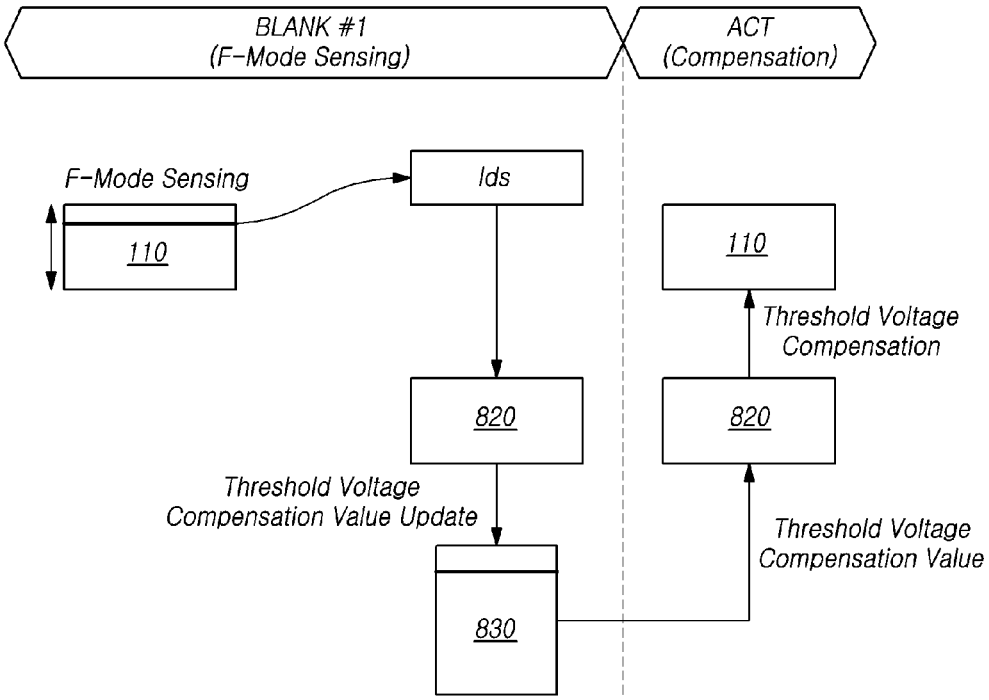
FIG. 14 is a diagram illustrating the display driving during an active period after the F-mode sensing driving in a blank period in the display device according to embodiments of the present disclosure.

FIG. 13 is a flowchart illustrating a real-time threshold voltage compensation method on the basis of the F-mode sensing of the display device 100 according to embodiments of the present disclosure, and FIG. 14 is a diagram illustrating the display driving during an active period after the F-mode sensing driving during a blank period BLANK in the display device 100 according to embodiments of the present disclosure.

Referring to FIG. 13, in S1300, during the first blank period BLANK #1, the compensation controller 820 reads the threshold voltage compensation value Vth_MEM stored in the memory 830 in order to start the F-mode sensing driving.

The compensation controller 820 determines the sensing driving data voltage Vdata_SEN on the basis of the threshold voltage compensation value Vth_MEM in S1302.

Referring to FIGS. 13 and 14, the compensation controller 820 controls the F-mode sensing driving to be performed using the sensing driving data voltage Vdata_SEN in S1304.

Referring to FIGS. 13 and 14, the compensation controller 820 determines whether or not a current flows through the driver transistor DRT on the basis of the output signal Vout of the comparator 810 in S1306.

When the current is determined not to flow through the driver transistor DRT, the compensation controller 820 determines the positive fine correction to be necessary in S1308. When the current is determined to flow through the driver transistor DRT, the compensation controller 820 determines the negative fine correction to be necessary in S1310.

The compensation controller 820 calculates and updates the sensing driving data voltage Vdata_SEN' to be used in the sensing driving during the next blank period according to the type of the fine correction (e.g., positive or negative fine correction) in S1312.

In the negative fine correction, the compensation controller 820 calculates the sensing driving data voltage Vdata_SEN' to be used in the sensing driving during the next blank period by subtracting the fine correction value FCV from the currently-used sensing driving data voltage Vdata_SEN.

In the positive fine correction, the compensation controller 820 calculates the sensing driving data voltage Vdata_SEN' to be used in the sensing driving during the next blank period by adding the fine correction value FCV to the currently-used sensing driving data voltage Vdata_SEN.

Referring to FIGS. 13 and 14, the compensation controller 820 updates the threshold voltage compensation value Vth_MEM stored in the memory 830 according to the type of the fine correction (e.g., positive or negative fine correction) in S1314.

When the negative fine correction for the threshold voltage compensation value Vth_MEM is determined to be necessary, the compensation controller 820 may update the threshold voltage compensation value Vth_MEM stored in the memory 830 by subtracting the fine correction value FCV from the threshold voltage compensation value Vth_MEM stored in the memory 830. The threshold voltage compensation value Vth_MEM' updated and stored in the memory 830 may be a value Vth_MEM−FCV obtained by subtracting the fine correction value FCV from the non-updated threshold voltage compensation value Vth_MEM.

When the positive fine correction for the threshold voltage compensation value Vth_MEM is determined to be necessary, the compensation controller 820 may update the threshold voltage compensation value Vth_MEM stored in the memory 830 by adding the fine correction value FCV to the threshold voltage compensation value Vth_MEM stored in the memory 830. The threshold voltage compensation value Vth_MEM' updated and stored in the memory 830 may be a value Vth_MEM+FCV obtained by adding the fine correction value FCV to the non-updated threshold voltage compensation value Vth_MEM.

Referring to FIG. 14, during the active period ACT in which an image update (e.g., image display driving) may be performed after the first blank period BLANK #1, the compensation controller 820 changes the image data using the threshold voltage compensation value Vth_MEM' updated and stored in the memory 830 and provides the changed image data to the data driver circuit 120.

The data driver circuit 120 converts the changed image data into an analog data voltage Vdata+Vth_MEM' (where Vdata is an analog voltage of non-changed image data) and drives the display panel 110 using the analog data voltage Vdata+Vth_MEM', so that the threshold voltage compensation is actually performed.

Figure 15:
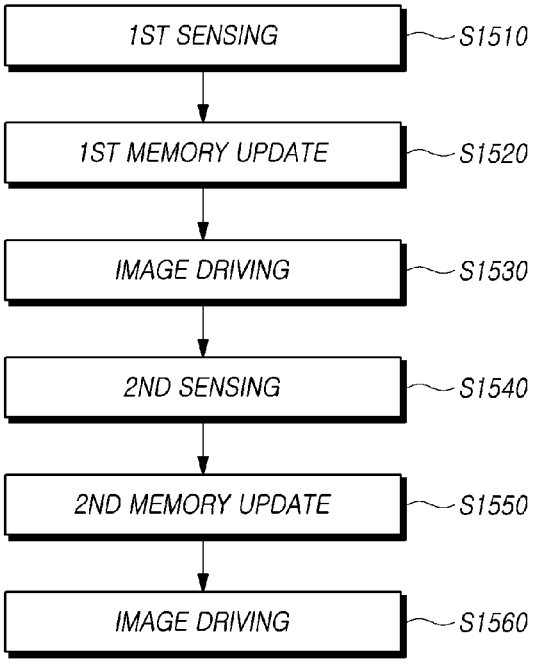
FIG. 15 is a flowchart illustrating a method of driving the display device according to embodiments of the present disclosure.

FIG. 15 is a flowchart illustrating a method of driving the display device 100 according to embodiments of the present disclosure.

Referring to FIG. 15, the method of driving the display device 100 according to embodiments of the present disclosure may include: a first sensing step S1510 of outputting the first data voltage Vdata_SEN #1 to the first data line DL1, from among the plurality of data lines DL, connected to the first subpixel SP1, from among the plurality of subpixels SP, during the first blank period BLANK #1; and a second sensing step S1540 of outputting the second data voltage Vdata_SEN #2, different from the first data voltage Vdata_SEN #1, to the first data line DL1 connected to the first subpixel SP1 during the second blank period BLANK #2 after the first blank period BLANK #1.

The second data voltage Vdata_SEN #2 supplied to the first data line DL1 during the second blank period BLANK #2 may be set different from the first data voltage Vdata_SEN #1 depending on whether the current flows through the driver transistor DRT in the first subpixel SP1 during the first blank period BLANK #1.

In the first sensing step S1510, during the first blank period BLANK #1, the first data voltage Vdata_SEN #1 may be supplied to the first subpixel SP1 through the first data line DL1, the reference voltage Vref may be supplied to the first subpixel SP1 through the first reference voltage line RVL1 from among the plurality of reference voltage lines RVL (see S1110 in FIG. 11), and the supply of the first data voltage Vdata_SEN #1 and the reference voltage Vref to the first subpixel SP1 may be stopped (see S1120 in FIG. 11).

In the second sensing step S1540, during the second blank period BLANK #2, the second data voltage Vdata_SEN #2 may be supplied to the first subpixel SP1 through the first data line DL1, the reference voltage Vref may be supplied to the first subpixel SP1 through the first reference voltage line RVL1, and the supply of the second data voltage Vdata_SEN #2 and the reference voltage Vref to the first subpixel SP1 may be stopped.

When the current Ids flows through the driver transistor DRT in the first subpixel SP1 during the first blank period BLANK #1, the second data voltage Vdata_SEN #2 supplied to the first data line DL1 during the second blank period BLANK #2 may be set less than the first data voltage Vdata_SEN #1.

When the current Ids does not flow through the driver transistor DRT in the first subpixel SP1 during the first blank period BLANK #1, the second data voltage Vdata_SEN #2 supplied to the first data line DL1 during the second blank period BLANK #2 may be set greater than the first data voltage Vdata_SEN #1.

When the current Ids flows through the driver transistor DRT in the first subpixel SP1 during the first blank period BLANK #1, the second data voltage Vdata_SEN #2 may be a voltage obtained by subtracting the preset fine correction value FCV from the first data voltage Vdata_SEN #1.

When the current Ids does not flow through the driver transistor DRT in the first subpixel SP1 during the first blank period BLANK #1, the second data voltage Vdata_SEN #2 may be a voltage obtained by adding the preset fine correction value FCV to the first data voltage Vdata_SEN #1.

Referring to FIG. 15, the method of driving the display device 100 according to embodiments of the present disclosure may further include a first memory update step S1520 of updating, by the compensation controller 820, the threshold voltage compensation value Vth_MEM stored in the memory 830 after the first sensing step S1510.

In the first memory update step S1520, when the current Ids flows through the driver transistor DRT in the first subpixel SP1 during the first blank period BLANK #1, the compensation controller 820 may update the threshold voltage compensation value Vth_MEM stored in the memory 830 to be reduced by the preset fine correction value FCV.

In the first memory update step S1520, when the current Ids does not flow through the driver transistor DRT in the first subpixel SP1 during the first blank period BLANK #1, the compensation controller 820 may update the threshold voltage compensation value Vth_MEM stored in the memory 830 to be increased by the preset fine correction value FCV.

Referring to FIG. 15, the method of driving the display device 100 according to embodiments of the present disclosure may further include, after the first memory update step S1520, an image driving step S1530 of supplying, by the controller 140, an image data voltage changed according to the threshold voltage compensation value Vth_MEM updated in the memory 830 to first subpixel SP1 through the first data line DL1 during the first active period after the first blank period BLANK #1.

Referring to FIG. 15, the method of driving the display device 100 according to embodiments of the present disclosure may further include: after the second sensing step S1540, a second memory update step S1550 of updating the threshold voltage compensation value Vth_MEM stored in the memory 830; and an image driving step S1560 of supplying, by the controller 140, the image data voltage changed according to the threshold voltage compensation value Vth_MEM updated in the memory 830 to the first subpixel SP1 through the first data line DL1.

The drive circuit of the display device 100 according to embodiments of the present disclosure may include the data voltage output circuit 800 outputting data voltages Vdata to the plurality of data lines DL and the power switch SPRE controlling the connection between the reference voltage supply node to which the reference voltage is applied and the reference voltage line RVL. Here, the drive circuit may be the data driver circuit 120 or include the data driver circuit 120.

The drive circuit of the display device 100 according to embodiments of the present disclosure may further include the comparator 810 and the sampling switch SAM as described above.

The data voltage output circuit 800 may output the first data voltage Vdata_SEN #1 to the first data line DL1 during the first blank period BLANK #1 and output the second data voltage Vdata_SEN #2, different from the first data voltage Vdata_SEN #1, to the first data line DL1 during the second blank period BLANK #2 after the first blank period BLANK #1.

The second data voltage Vdata_SEN #2 supplied to the first data line DL1 during the second blank period BLANK #2 may be set different from the first data voltage Vdata_SEN #1 depending on whether or not the current flows through the driver transistor DRT in the first subpixel SP1 during the first blank period BLANK #1.

During the first blank period BLANK #1, the data voltage output circuit 800 may output the first data voltage Vdata_SEN #1 to the first data line DL1 connected to the first subpixel SP1, and the power switch SPRE may be turned on to output the reference voltage to the first reference voltage line RVL1 connected to the first subpixel SP1, from among the plurality of reference voltage lines RVL, and then, be turned off.

During the second blank period BLANK #2, the data voltage output circuit 800 may output the second data voltage Vdata_SEN #2, different from the first data voltage Vdata_SEN #1, to the first data line DL1, and the power switch SPRE may be turned on to output the reference voltage to the first reference voltage line RVL1, and then, be turned off.

As set forth above, embodiments of the present disclosure may provide the display device 100, the drive circuit, and the driving method able to compensate for a change in the threshold voltage of the driver transistors DRT in real time during the display driving.

The above description has been presented to enable any person skilled in the art to make and use the technical idea of the present invention, and has been provided in the context of a particular application and its requirements. Various modifications, additions and substitutions to the described embodiments will be readily apparent to those skilled in the art, and the general principles defined herein may be applied to other embodiments and applications without departing from the spirit and scope of the present invention. The above description and the accompanying drawings provide an example of the technical idea of the present invention for illustrative purposes only. That is, the disclosed embodiments are intended to illustrate the scope of the technical idea of the present invention. Thus, the scope of the present invention is not limited to the embodiments shown, but is to be accorded the widest scope consistent with the claims. The scope of protection of the present invention should be construed based on the following claims, and all technical ideas within the scope of equivalents thereof should be construed as being included within the scope of the present invention.

What is claimed is:

1. A display device comprising:

a display panel comprising a plurality of data lines, a plurality of scan signal lines, a plurality of sense signal lines, a plurality of reference voltage lines, and a plurality of subpixels, each of the plurality of subpixels comprising an emitting diode, a driver transistor, and a storage capacitor;

a data driver circuit configured to output image data voltages to the plurality of data lines; and a gate driver circuit configured to output scan signals to the plurality of scan signal lines and output sense signals to the plurality of sense signal lines, wherein the plurality of subpixels include a first subpixel connected to a first data line from among the plurality of data lines and a first reference voltage line from among the plurality of reference voltage lines, wherein the data driver circuit is configured to output a sensing driving first data voltage to the first data line during a first blank period and output a sensing driving second data voltage that is different from the sensing driving first data voltage to the first data line during a second blank period that is after the first blank period, and wherein the second data voltage supplied to the first data line during the second blank period is set different from the first data voltage depending on whether a current flows through a driver transistor in the first subpixel during the first blank period, wherein, when the current flows through the driver transistor in the first subpixel during the first blank period, the sensing driving second data voltage supplied to the first data line during the second blank period is set less than the sensing driving first data voltage, and when the current does not flow through the driver transistor in the first subpixel during the first blank period, the sensing driving second data voltage supplied to the first data line during the second blank period is set greater than the sensing driving first data voltage.

2. The display device according to claim 1, wherein, during the first blank period, the first data voltage is supplied to the first subpixel through the first data line, after a reference voltage is supplied to the first subpixel through the first reference voltage line, a supply of the first data voltage and the reference voltage to the first subpixel is stopped, and during the second blank period, the second data voltage is supplied to the first subpixel through first data line, after the reference voltage is supplied to the first subpixel through the first reference voltage line, and a supply of the second data voltage and the reference voltage to the first subpixel is stopped.

3. The display device according to claim 1, wherein, when the current flows through the driver transistor in the first subpixel during the first blank period, the sensing driving second data voltage is a voltage obtained by subtracting a preset fine correction value from the sensing driving first data voltage, and when the current does not flow through the driver transistor in the first subpixel during the first blank period, the sensing driving second data voltage is a voltage obtained by adding the preset fine correction value to the sensing driving first data voltage.

4. The display device according to claim 3, wherein the fine correction value is a minimum voltage settable in an integrated circuit corresponding to the data driver circuit.

5. The display device according to claim 1, further comprising:

a memory storing a threshold voltage compensation value for the driver transistor in the first subpixel; and a compensation controller updating the threshold voltage compensation value stored in the memory, wherein, when the current flows through the driver transistor in the first subpixel during the first blank period, the compensation controller updates the threshold voltage compensation value stored in the memory to be reduced by a preset fine correction value, and when the current does not flow through the driver transistor in the first subpixel during the first blank period, the compensation controller updates the threshold voltage compensation value stored in the memory to be increased by the preset fine correction value.

6. The display device according to claim 5, wherein, during a first active period after the first blank period, the data driver circuit is configured to supply an image data voltage changed according to the threshold voltage compensation value updated in the memory to the first subpixel through the first data line.

7. The display device according to claim 1, wherein the first subpixel comprises an emitting diode, the driver transistor driving the emitting diode, a scan transistor controlled by the scan signal and controlling a connection between a first node of the driver transistor and the first data line, a sense transistor controlled by the sense signal and controlling a connection between a second node of the driver transistor and the first reference voltage line, and a storage capacitor electrically connected between the first node and the second node of the driver transistor, the display device further comprising:

a power switch controlling connection between the first reference voltage line and a reference voltage supply node;

a comparator comprising a first input terminal to which a voltage from the first reference voltage line is input, a second input terminal electrically connected to the reference voltage supply node, an output terminal outputting a first output voltage or a second output voltage less than the first output voltage as an output signal depending on magnitudes of the voltages of the first input terminal and the second input terminal; and a sampling switch controlling the first input terminal of the comparator and the first reference voltage line.

8. The display device according to claim 7, wherein the comparator further comprises a first supply input terminal to which a first supply voltage is input and a second supply input terminal to which a second supply voltage lower than the first supply voltage is input, and the comparator has a gain causing the first output voltage to be the same as the first supply voltage and the second output voltage to be the same as the second supply voltage.

9. The display device according to claim 1, wherein blank periods, a number of which is equal to or less than a number of the subpixels in the display panel, are provided between the first blank period and the second blank period.

10. A method of driving a display device comprising a plurality of data lines, a plurality of scan signal lines, a plurality of sense signal lines, a plurality of reference voltage lines, and a plurality of subpixels, the method comprising:

a first sensing operation of outputting a sensing driving first data voltage to a first data line, from among plurality of data lines, connected to a first subpixel, from among a plurality of subpixels, during a first blank period; and a second sensing operation of outputting a sensing driving second data voltage that is different from the sensing driving first data voltage to the first data line connected to the first subpixel during a second blank period after the first blank period, wherein the sensing driving second data voltage supplied to the first data line during the second blank period is set different from the sensing driving first data voltage depending on whether or not a current flows through a driver transistor in the first subpixel during the first blank period, wherein, when the current flows through the driver transistor in the first subpixel during the first blank period, the sensing driving second data voltage supplied to the first data line during the second blank period is set less than the sensing driving first data voltage, and when the current does not flow through the driver transistor in the first subpixel during the first blank period, the sensing driving second data voltage supplied to the first data line during the second blank period is set greater than the sensing driving first data voltage.

11. A drive circuit of a display device comprising a plurality of data lines, a plurality of scan signal lines, a plurality of sense signal lines, a plurality of reference voltage lines, and a plurality of subpixels, the drive circuit comprising:

a data voltage output circuit configured to output data voltages to the plurality of data lines; and a power switch configured to control a connection between a reference voltage supply node to which a reference voltage is applied and a corresponding reference voltage line from among the plurality of reference voltage lines, wherein the data voltage output circuit is configured to output a sensing driving first data voltage to the first data line during a first blank period and output a sensing driving second data voltage different from the sensing driving first data voltage to the first data line during a second blank period after the first blank period, and the sensing driving second data voltage supplied to the first data line during the second blank period is set different from the sensing driving first data voltage depending on whether or not a current flows through a driver transistor in the first subpixel during the first blank period, wherein, when the current flows through the driver transistor in the first subpixel during the first blank period, the sensing driving second data voltage supplied to the first data line during the second blank period is set less than the sensing driving first data voltage, and when the current does not flow through the driver transistor in the first subpixel during the first blank period, the sensing driving second data voltage supplied to the first data line during the second blank period is set greater than the sensing driving first data voltage.

12. The drive circuit according to claim 11, further comprising:

a comparator comprising a first input terminal to which a voltage from the reference voltage line is input, a second input terminal electrically connected to the reference voltage supply node, an output terminal outputting a first output voltage or a second output voltage that is less than the first output voltage as an output signal depending on magnitudes of the voltages of the first input terminal and the second input terminal; and a sampling switch controlling the first input terminal of the comparator and the reference voltage line.

13. The display device of claim 1, wherein the sensing driving first data voltage and the sensing driving second data voltage are supplied to the driver transistor in an initialization time of a sensing driving time in which the driver transistor is initialized.

* * * * *